US007498996B2

(12) United States Patent
Shtrom et al.

(10) Patent No.: US 7,498,996 B2
(45) Date of Patent: Mar. 3, 2009

(54) ANTENNAS WITH POLARIZATION DIVERSITY

(75) Inventors: Victor Shtrom, Sunnyvale, CA (US); William Kish, Sunnyvale, CA (US); Bernard Barron, Sunnyvale, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 29 days.

(21) Appl. No.: 11/646,136

(22) Filed: Dec. 26, 2006

(65) Prior Publication Data

US 2008/0129640 A1 Jun. 5, 2008

Related U.S. Application Data

(63) Continuation-in-part of application No. 11/041,145, filed on Jan. 21, 2005, now Pat. No. 7,362,280.

(60) Provisional application No. 60/602,711, filed on Aug. 18, 2004, provisional application No. 60/603,157, filed on Aug. 18, 2004, provisional application No. 60/753,442, filed on Dec. 23, 2005, provisional application No. 60/865,148, filed on Nov. 9, 2006.

(51) Int. Cl.
*H01Q 9/28* (2006.01)
*H01Q 21/00* (2006.01)

(52) U.S. Cl. ..... 343/795; 343/893

(58) Field of Classification Search ..... 343/700 MS, 343/702, 795, 818, 876, 893
See application file for complete search history.

(56) References Cited

U.S. PATENT DOCUMENTS

| | | | |
|---|---|---|---|
| 723,188 | A | 3/1903 | Tesla |
| 725,605 | A | 4/1903 | Tesla |
| 1,869,659 | A | 8/1932 | Broertjes |
| 2,292,387 | A | 8/1942 | Markey et al. |
| 3,488,445 | A | 1/1970 | Chang |
| 3,568,105 | A | 3/1971 | Felsenheld |
| 3,967,067 | A | 6/1976 | Potter |

(Continued)

FOREIGN PATENT DOCUMENTS

| | | |
|---|---|---|
| EP | 0 534 612 | 3/1993 |

(Continued)

OTHER PUBLICATIONS

"Authorization of Spread Spectrum Systems Under Parts 15 and 90 of the FCC Rules and Regulations," Rules and Regulations Federal Communications Commission, 47 CFR Part 2, 15, and 90, Jun. 18, 1985.

(Continued)

*Primary Examiner*—Shih-Chao Chen
(74) *Attorney, Agent, or Firm*—Carr & Ferrell LLP

(57) ABSTRACT

A horizontally polarized antenna array allows for the efficient distribution of RF energy into a communications environment through selectable antenna elements and redirectors that create a particular radiation pattern such as a substantially omnidirectional radiation pattern. In conjunction with a vertically polarized array, a particular high-gain wireless environment may be created such that one environment does not interfere with other nearby wireless environments and avoids interference created by those other environments. Lower gain patterns may also be created by using particular configurations of a horizontal and/or vertical antenna array. In a preferred embodiment, the antenna systems disclosed herein are utilized in a multiple-input, multiple-output (MIMO) wireless environment.

27 Claims, 14 Drawing Sheets

U.S. PATENT DOCUMENTS

| | | | | |
|---|---|---|---|---|
| 3,982,214 | A | 9/1976 | Burns | |
| 3,991,273 | A | 11/1976 | Mathes | |
| 4,001,734 | A | 1/1977 | Burns | |
| 4,176,356 | A | 11/1979 | Foster et al. | |
| 4,193,077 | A | 3/1980 | Greenberg et al. | |
| 4,305,052 | A | 12/1981 | Baril et al. | |
| 4,554,554 | A | 11/1985 | Olesen et al. | |
| 4,733,203 | A | 3/1988 | Ayasli | |
| 4,814,777 | A | 3/1989 | Monser | |
| 5,063,574 | A | 11/1991 | Moose | |
| 5,173,711 | A | 12/1992 | Takeuchi et al. | |
| 5,208,564 | A | 5/1993 | Burns et al. | |
| 5,220,340 | A | 6/1993 | Shafai | |
| 5,282,222 | A | 1/1994 | Fattouche et al. | |
| 5,291,289 | A | 3/1994 | Hulyalkar et al. | |
| 5,311,550 | A | 5/1994 | Fouche et al. | |
| 5,532,708 | A | 7/1996 | Krenz et al. | |
| 5,559,800 | A | 9/1996 | Mousseau et al. | |
| 5,754,145 | A | 5/1998 | Evans | |
| 5,767,755 | A | 6/1998 | Kim et al. | |
| 5,767,809 | A | 6/1998 | Chuang et al. | |
| 5,786,793 | A * | 7/1998 | Maeda et al. | 343/700 MS |
| 5,802,312 | A | 9/1998 | Lazaridis et al. | |
| 5,964,830 | A | 10/1999 | Durett | |
| 5,990,838 | A | 11/1999 | Burns et al. | |
| 6,031,503 | A | 2/2000 | Preiss, II et al. | |
| 6,034,638 | A | 3/2000 | Thiel et al. | |
| 6,052,093 | A | 4/2000 | Yao et al. | |
| 6,091,364 | A * | 7/2000 | Murakami et al. | 343/700 MS |
| 6,094,177 | A | 7/2000 | Yamamoto | |
| 6,097,347 | A | 8/2000 | Duan et al. | |
| 6,104,356 | A | 8/2000 | Hikuma et al. | |
| 6,169,523 | B1 | 1/2001 | Ploussios | |
| 6,266,528 | B1 | 7/2001 | Farzaneh | |
| 6,292,153 | B1 | 9/2001 | Aiello et al. | |
| 6,307,524 | B1 | 10/2001 | Britain | |
| 6,317,599 | B1 | 11/2001 | Rappaport et al. | |
| 6,323,810 | B1 | 11/2001 | Poilasne et al. | |
| 6,326,922 | B1 | 12/2001 | Hegendoerfer | |
| 6,337,628 | B2 | 1/2002 | Campana, Jr. | |
| 6,337,668 | B1 | 1/2002 | Ito et al. | |
| 6,339,404 | B1 | 1/2002 | Johnson et al. | |
| 6,345,043 | B1 | 2/2002 | Hsu | |
| 6,356,242 | B1 | 3/2002 | Ploussios | |
| 6,356,243 | B1 | 3/2002 | Schneider et al. | |
| 6,356,905 | B1 | 3/2002 | Gershman et al. | |
| 6,377,227 | B1 | 4/2002 | Zhu et al. | |
| 6,392,610 | B1 | 5/2002 | Braun et al. | |
| 6,404,386 | B1 | 6/2002 | Proctor, Jr. et al. | |
| 6,407,719 | B1 * | 6/2002 | Ohira et al. | 343/893 |
| RE37,802 | E | 7/2002 | Fattouche et al. | |
| 6,424,311 | B1 | 7/2002 | Tsai et al. | |
| 6,442,507 | B1 | 8/2002 | Skidmore et al. | |
| 6,445,688 | B1 | 9/2002 | Garces et al. | |
| 6,456,242 | B1 | 9/2002 | Crawford | |
| 6,493,679 | B1 | 12/2002 | Rappaport et al. | |
| 6,496,083 | B1 | 12/2002 | Kushitani et al. | |
| 6,498,589 | B1 | 12/2002 | Horii | |
| 6,499,006 | B1 | 12/2002 | Rappaport et al. | |
| 6,507,321 | B2 | 1/2003 | Oberschmidt et al. | |
| 6,531,985 | B1 | 3/2003 | Jones et al. | |
| 6,583,765 | B1 | 6/2003 | Schamberger et al. | |
| 6,586,786 | B2 | 7/2003 | Kitazawa et al. | |
| 6,611,230 | B2 | 8/2003 | Phelan | |
| 6,625,454 | B1 | 9/2003 | Rappaport et al. | |
| 6,633,206 | B1 | 10/2003 | Kato | |
| 6,642,889 | B1 | 11/2003 | McGrath | |
| 6,674,459 | B2 | 1/2004 | Ben-Shachar et al. | |
| 6,701,522 | B1 | 3/2004 | Rubin et al. | |
| 6,725,281 | B1 | 4/2004 | Zintel et al. | |
| 6,753,814 | B2 | 6/2004 | Killen et al. | |
| 6,762,723 | B2 | 7/2004 | Nallo et al. | |
| 6,779,004 | B1 | 8/2004 | Zintel | |
| 6,819,287 | B2 | 11/2004 | Sullivan et al. | |
| 6,839,038 | B2 | 1/2005 | Weinstein | |
| 6,859,176 | B2 | 2/2005 | Choi | |
| 6,859,182 | B2 | 2/2005 | Horii | |
| 6,876,280 | B2 | 4/2005 | Nakano | |
| 6,876,836 | B2 | 4/2005 | Lin et al. | |
| 6,888,504 | B2 | 5/2005 | Chiang et al. | |
| 6,888,893 | B2 | 5/2005 | Li et al. | |
| 6,892,230 | B1 | 5/2005 | Gu et al. | |
| 6,903,686 | B2 | 6/2005 | Vance et al. | |
| 6,906,678 | B2 | 6/2005 | Chen | |
| 6,910,068 | B2 | 6/2005 | Zintel et al. | |
| 6,914,581 | B1 | 7/2005 | Popek | |
| 6,924,768 | B2 | 8/2005 | Wu et al. | |
| 6,931,429 | B2 | 8/2005 | Gouge et al. | |
| 6,941,143 | B2 | 9/2005 | Mathur | |
| 6,943,749 | B2 | 9/2005 | Paun | |
| 6,950,019 | B2 | 9/2005 | Bellone et al. | |
| 6,950,069 | B2 | 9/2005 | Gaucher et al. | |
| 6,961,028 | B2 | 11/2005 | Joy et al. | |
| 6,965,353 | B2 | 11/2005 | Shirosaka et al. | |
| 6,973,622 | B1 | 12/2005 | Rappaport et al. | |
| 6,975,834 | B1 | 12/2005 | Forster | |
| 6,980,782 | B1 | 12/2005 | Braun et al. | |
| 7,023,909 | B1 | 4/2006 | Adams et al. | |
| 7,034,769 | B2 | 4/2006 | Surducan et al. | |
| 7,034,770 | B2 | 4/2006 | Yang et al. | |
| 7,043,277 | B1 | 5/2006 | Pfister | |
| 7,050,809 | B2 | 5/2006 | Lim | |
| 7,053,844 | B2 | 5/2006 | Gaucher et al. | |
| 7,064,717 | B2 | 6/2006 | Kaluzni et al. | |
| 7,085,814 | B1 | 8/2006 | Gandhi et al. | |
| 7,088,299 | B2 | 8/2006 | Siegler et al. | |
| 7,089,307 | B2 | 8/2006 | Zintel et al. | |
| 7,130,895 | B2 | 10/2006 | Zintel et al. | |
| 7,171,475 | B2 | 1/2007 | Weisman et al. | |
| 7,277,063 | B2 | 10/2007 | Shirosaka et al. | |
| 7,312,762 | B2 * | 12/2007 | Puente Ballarda et al. | 343/752 |
| 7,319,432 | B2 | 1/2008 | Andersson | |
| 2001/0046848 | A1 | 11/2001 | Kenkel | |
| 2002/0031130 | A1 | 3/2002 | Tsuchiya et al. | |
| 2002/0047800 | A1 | 4/2002 | Proctor, Jr. et al. | |
| 2002/0080767 | A1 | 6/2002 | Lee | |
| 2002/0084942 | A1 | 7/2002 | Tsai et al. | |
| 2002/0105471 | A1 | 8/2002 | Kojima et al. | |
| 2002/0112058 | A1 | 8/2002 | Weisman et al. | |
| 2002/0158798 | A1 | 10/2002 | Chiang et al. | |
| 2002/0170064 | A1 | 11/2002 | Monroe et al. | |
| 2003/0026240 | A1 | 2/2003 | Eyuboglu et al. | |
| 2003/0030588 | A1 | 2/2003 | Kalis et al. | |
| 2003/0063591 | A1 | 4/2003 | Leung et al. | |
| 2003/0122714 | A1 | 7/2003 | Wannagot et al. | |
| 2003/0169330 | A1 | 9/2003 | Ben-Shachar et al. | |
| 2003/0184490 | A1 | 10/2003 | Raiman et al. | |
| 2003/0189514 | A1 | 10/2003 | Miyano et al. | |
| 2003/0189521 | A1 | 10/2003 | Yamamoto et al. | |
| 2003/0189523 | A1 | 10/2003 | Ojantakanen et al. | |
| 2003/0210207 | A1 | 11/2003 | Suh et al. | |
| 2003/0227414 | A1 | 12/2003 | Saliga et al. | |
| 2004/0014432 | A1 | 1/2004 | Boyle | |
| 2004/0017310 | A1 | 1/2004 | Runkle et al. | |
| 2004/0017860 | A1 | 1/2004 | Liu | |
| 2004/0027291 | A1 | 2/2004 | Zhang et al. | |
| 2004/0027304 | A1 | 2/2004 | Chiang et al. | |
| 2004/0032378 | A1 | 2/2004 | Volman et al. | |
| 2004/0036651 | A1 | 2/2004 | Toda | |
| 2004/0036654 | A1 | 2/2004 | Hsieh | |
| 2004/0041732 | A1 | 3/2004 | Aikawa et al. | |
| 2004/0048593 | A1 | 3/2004 | Sano | |
| 2004/0058690 | A1 | 3/2004 | Ratzel et al. | |
| 2004/0061653 | A1 | 4/2004 | Webb et al. | |

| | | | |
|---|---|---|---|
| 2004/0070543 | A1 | 4/2004 | Masaki |
| 2004/0080455 | A1 | 4/2004 | Lee |
| 2004/0095278 | A1 | 5/2004 | Kanemoto et al. |
| 2004/0114535 | A1 | 6/2004 | Hoffmann et al. |
| 2004/0125777 | A1 | 7/2004 | Doyle et al. |
| 2004/0145528 | A1 | 7/2004 | Mukai et al. |
| 2004/0160376 | A1 | 8/2004 | Hornsby et al. |
| 2004/0190477 | A1 | 9/2004 | Olson et al. |
| 2004/0203347 | A1 | 10/2004 | Nguyen |
| 2004/0260800 | A1 | 12/2004 | Gu et al. |
| 2005/0022210 | A1 | 1/2005 | Zintel et al. |
| 2005/0041739 | A1 | 2/2005 | Li et al. |
| 2005/0042988 | A1 | 2/2005 | Hoek et al. |
| 2005/0048934 | A1 | 3/2005 | Rawnick et al. |
| 2005/0074108 | A1 | 4/2005 | Zintel et al. |
| 2005/0097503 | A1 | 5/2005 | Zintel et al. |
| 2005/0128983 | A1 | 6/2005 | Kim et al. |
| 2005/0135480 | A1 | 6/2005 | Li et al. |
| 2005/0138137 | A1 | 6/2005 | Encarnacion et al. |
| 2005/0138193 | A1 | 6/2005 | Encarnacion et al. |
| 2005/0146475 | A1 | 7/2005 | Bettner et al. |
| 2005/0180381 | A1 | 8/2005 | Retzer et al. |
| 2005/0188193 | A1 | 8/2005 | Kuehnel et al. |
| 2005/0240665 | A1 | 10/2005 | Gu et al. |
| 2005/0267935 | A1 | 12/2005 | Ghandi et al. |
| 2006/0094371 | A1 | 5/2006 | Nguyen |
| 2006/0098607 | A1 | 5/2006 | Zeng et al. |
| 2006/0123124 | A1 | 6/2006 | Weisman et al. |
| 2006/0123125 | A1 | 6/2006 | Weisman et al. |
| 2006/0123455 | A1 | 6/2006 | Pai et al. |
| 2006/0168159 | A1 | 7/2006 | Weisman et al. |
| 2006/0184661 | A1 | 8/2006 | Weisman et al. |
| 2006/0184693 | A1 | 8/2006 | Rao et al. |
| 2006/0187660 | A1 | 8/2006 | Rao et al. |
| 2006/0224690 | A1 | 10/2006 | Falkenburg et al. |
| 2006/0225107 | A1 | 10/2006 | Seetharaman et al. |
| 2006/0227761 | A1 | 10/2006 | Scott, III et al. |
| 2006/0239369 | A1 | 10/2006 | Lee |
| 2006/0262015 | A1 | 11/2006 | Thornell-Pers et al. |
| 2006/0291434 | A1 | 12/2006 | Gu et al. |
| 2007/0027622 | A1 | 2/2007 | Cleron et al. |
| 2007/0135167 | A1 | 6/2007 | Liu |

FOREIGN PATENT DOCUMENTS

| | | |
|---|---|---|
| EP | 1 376 920 | 6/2002 |
| EP | 1 315 311 | 5/2003 |
| EP | 1 450 521 | 8/2004 |
| EP | 1 608 108 | 12/2005 |
| JP | 2008/088633 | 2/1996 |
| JP | 2001/057560 | 2/2002 |
| JP | 2005/354249 | 12/2005 |
| JP | 2006/060408 | 3/2006 |
| WO | WO 90/04893 | 5/1990 |
| WO | WO 02/25967 | 3/2002 |
| WO | WO 03/079484 | 9/2003 |

OTHER PUBLICATIONS

"Authorization of spread spectrum and other wideband emissions not presently provided for in the FCC Rules and Regulations," Before the Federal Communications Commission, FCC 81-289, 87 F.C.C.2d 876, Jun. 30, 1981.

RL Miller, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.

Chang, Robert W., "Synthesis of Band-Limited Orthogonal Signals for Mutichannel Data Transmission," The Bell System Technical Journal, Dec. 1966, pp. 1775-1796.

Cimini, Jr., Leonard J, "Analysis and Simulation of a Digital Mobile Channel Using Orthogonal Frequency Division Multiplexing," IEEE Transactions on Communications, vol. Com-33, No. 7, Jul. 1985, pp. 665-675.

Saltzberg, Burton R., "Performance of an Efficient Parallel Data Transmission System," IEEE Transactions on Communication Technology, vol. Com-15, No. 6, Dec. 1967, pp. 805-811.

Weinstein, S. B., et al., "Data Transmission by Frequency-Division Multiplexing Using the Discrete Fourier Transform," IEEE Transactions on Communication Technology, vol. Com-19, No. 5, Oct. 1971, pp. 628-634.

Moose, Paul H., "Differential Modulation and Demodulation of Multi-Frequency Digital Communications Signals," 1990 IEEE, CH2831-6/90/0000-0273.

Casas, Eduardo F., et al., "OFDM for Data Communication Over Mobile Radio FM Channels-Part I: Analysis and Experimental Results," IEEE Transactions on Communications, vol. 39, No. 5, May 1991, pp. 783-793.

Casas, Eduardo F., et al., "OFDM for Data Communication over Mobile Radio FM Channels; Part II: Performance Improvement," Department of Electrical Engineering, University of British Columbia, no date.

Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.

Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.

Alard, M., et al., "Principles of Modulation and Channel Coding for Digital Broadcasting for Mobile Receivers," 8301 EBU Review Technical, Aug. 1987, No. 224, Brussels, Belgium.

Berenguer, Inaki, et al., "Adaptive MIMO Antenna Selection," Nov. 2003.

Gaur, Sudhanshu, et al., "Transmit/Receive Antenna Selection for MIMO Systems to Improve Error Performance of Linear Receivers," School of ECE, Georgia Institute of Technology, Apr. 4, 2005.

Sadek, Mirette, et al., "Active Antenna Selection in Multiuser MIMO Communications," IEEE Transactions on Signal Processing, vol. 55, No. 4, Apr. 2007, pp. 1498-1510.

Molisch, Andreas F., et al., "MIMO Systems with Antenna Selection-an Overview," Draft, Dec. 31, 2003.

Ken Tang, et al., "MAC Layer Broadcast Support in 802.11 Wireless Networks," Computer Science Department, University of California, Los Angeles, 2000 IEEE, pp. 544-548.

Ken Tang, et al., "MAC Reliable Broadcast in Ad Hoc Networks," Computer Science Department, University of California, Los Angeles, 2001 IEEE, pp. 1008-1013.

Vincent D. Park, et al., "A Performance Comparison of the Temporally-Ordered Routing Algorithm and Ideal Link-State Routing," IEEE, Jul. 1998, pp. 592-598.

Ian R. Akyildiz, et al., "A Virtual Topology Based Routing Protocol for Multihop Dynamic Wireless Networks," Broadband and Wireless Networking Lab, School of Electrical and Computer Engineering, Georgia Institute of Technology, no date.

Dell Inc., "How Much Broadcast and Multicast Traffic Should I Allow in My Network," PowerConnect Application Note #5, Nov. 2003.

Toskala, Antti, "Enhancement of Broadcast and Introduction of Multicast Capabilities in RAN," Nokia Networks, Palm Springs, California, Mar. 13-16, 2001.

Microsoft Corporation, "IEEE 802.11 Networks and Windows XP," Windows Hardware Developer Central, Dec. 4, 2001.

Festag, Andreas, "What is MOMBASA?" Telecommunication Networks Group (TKN), Technical University of Berlin, Mar. 7, 2002.

Hewlett Packard, "HP ProCurve Networking: Enterprise Wireless LAN Networking and Mobility Solutions," 2003.

Dutta, Ashutosh et al., "MarconiNet Supporting Streaming Media Over Localized Wireless Multicast," Proc. of the 2d Int'l Workshop on Mobile Commerce, 2002.

Dunkels, Adam et al., "Making TCP/IP Viable for Wireless Sensor Networks," Proc. of the 1st Euro. Workshop on Wireless Sensor Networks, Berlin, Jan. 2004.

Dunkels, Adam et al., "Connecting Wireless Sensornets with TCP/IP Networks," Proc. of the 2d Int'l Conf. on Wired Networks, Frankfurt, Feb. 2004.

Cisco Systems, "Cisco Aironet Access Point Software Configuration Guide: Configuring Filters and Quality of Service," Aug. 2003.
Hirayama, Koji et al., "Next-Generation Mobile-Access IP Network," Hitachi Review vol. 49, No. 4, 2000.
Pat Calhoun et al., "802.11r strengthens wireless voice," Technology Update, Network World, Aug. 22, 2005, http://www.networkworld.com/news/tech/2005/082208techupdate.html.
Areg Alimian et al., "Analysis of Roaming Techniques," doc.:IEEE 802.11-04/0377r1, Submission, Mar. 2004.
Information Society Technologies Ultrawaves, "System Concept / Architecture Design and Communication Stack Requirement Document," Feb. 23, 2004.
Golmie, Nada, "Coexistence in Wireless Networks: Challenges and System-Level Solutions in the Unlicensed Bands," Cambridge University Press, 2006.
Mawa, Rakesh, "Power Control in 3G Systems," Hughes Systique Corporation, Jun. 28, 2006.
Wennstrom, Mattias et al., "Transmit Antenna Diversity in Ricean Fading MIMO Channels with Co-Channel Interference," 2001.
Steger, Christopher et al., "Performance of IEEE 802.11b Wireless LAN in an Emulated Mobile Channel," 2003.
Chang, Nicholas B. et al., "Optimal Channel Probing and Transmission Scheduling for Opportunistics Spectrum Access," Sep. 2007.
Chuang et al., A 2.4 GHz Polarization-diversity Planar Printed Dipole Antenna for WLAN and Wireless Communication Applications, Microwave Journal, vol. 45, No. 6, pp. 50-62 (Jun. 2002).
Frederick et al., Smart Antennas Based on Spatial Multiplexing of Local Elements (SMILE) for Mutual Coupling Reduction, IEEE Transactions of Antennas and Propogation, vol. 52., No. 1, pp. 106-114 (Jan. 2004).
W.E. Doherty, Jr. et al., The Pin Diode Circuit Designer's Handbook 1998.
Varnes et al., A Switched Radial Divider for an L-Band Mobile Satellite Antenna, European Microwave Conference (Oct. 1995), pp. 1037-1041.
English Translation of PCT Pub. No. WO2004/051798 (as filed U.S. Appl. No. 10/536,547).
Behdad et al., Slot Antenna Miniaturization Using Distributed Inductive Loading, Antenna and Propagation Society International Symposium, 2003 IEEE, vol. 1, pp. 308-311 (Jun. 2003).
Press Release, NETGEAR RangeMax(TM) Wireless Networking Solutions Incorporate Smart MIMO Technology To Eliminate Wireless Dead Spots and Take Consumers Farther, Ruckus Wireles Inc. (Mar. 7, 2005), available at http://ruckuswireless.com/press/releases/20050307.php.

* cited by examiner

100

ANTENNAS WITH POLARIZATION DIVERSITY

CROSS-REFERENCE TO RELATED APPLICATIONS

The present application is a continuation-in-part of U.S. patent application Ser. No. 11/041,145 filed Jan. 21, 2005 now U.S. Pat. No. 7,362,280 and entitled "System and Method for a Minimized Antenna Apparatus with Selectable Elements," which claims the priority benefit of U.S. provisional patent application No. 60/602,711 filed Aug. 18, 2004 and entitled "Planar Antenna Apparatus for Isotropic Coverage and QoS Optimization in Wireless Networks" and U.S. provisional patent application No. 60/603,157 filed Aug. 18, 2004 and entitled "Software for Controlling a Planar Antenna Apparatus for Isotropic Coverage and QoS Optimization in Wireless Networks"; the present application also claims the priority benefit of U.S. provisional patent application No. 60/753,442 filed Dec. 23, 2005 and entitled "Coaxial Antennas with Polarization Diversity." The disclosures of the aforementioned applications are incorporated herein by reference.

This application is related to U.S. provisional patent application No. 60/865,148 filed Nov. 9, 2006 and entitled "Multiple Input Multiple Output (MIMO) Antenna Configurations," the disclosure of which is incorporated herein by reference.

BACKGROUND OF THE INVENTION

1. Field of the Invention

The present invention relates generally to wireless communications and more particularly to antenna systems with polarization diversity.

2. Description of the Related Art

In communications systems, there is an ever-increasing demand for higher data throughput and a corresponding drive to reduce interference that can disrupt data communications. For example, in an Institute of Electrical and Electronics Engineers, Inc. (IEEE) 802.11 network, an access point such as a base station may communicate with one or more remote receiving nodes such as a network interface card over a wireless link. The wireless link may be susceptible to interference from other access points and stations (nodes), other radio transmitting devices, changes or disturbances in the wireless link environment between the access point and the remote receiving node and so forth. The interference may be such to degrade the wireless link by forcing communication at a lower data rate or may be sufficiently strong as to completely disrupt the wireless link.

One solution for reducing interference in the wireless link between the access point and the remote receiving node is to provide several omnidirectional antennas in a 'diversity' scheme. In such an implementation, a common configuration for the access point includes a data source coupled via a switching network to two or more physically separated omnidirectional antennas. The access point may select one of the omnidirectional antennas by which to maintain the wireless link. Because of the separation between the omnidirectional antennas, each antenna experiences a different signal environment and each antenna contributes a different interference level to the wireless link. The switching network couples the data source to whichever of the omnidirectional antennas experiences the least interference in the wireless link.

One problem with using two or more omnidirectional antennas for the access point is that typical omnidirectional antennas are vertically polarized. Vertically polarized radio frequency (RF) energy does not travel as efficiently as, for example, horizontally polarized RF energy inside an office or dwelling space. To date, prior art solutions for creating horizontally polarized RF antennas have not provided adequate RF performance to be commercially successful.

SUMMARY OF THE INVENTION

The gain of an antenna is a passive phenomenon as antennas conserve energy. Power is not added by an antenna but redistributed to provide more radiated power in a certain direction than would be transmitted by, for example, an isotropic antenna. Thus, if an antenna has a gain of greater than one in some directions, the antenna must have a gain of less than one in other directions. High-gain antennas have the advantage of longer range and better signal quality but require careful aiming in a particular direction. Low-gain antennas have shorter range but antenna orientation is generally inconsequential.

With these principles in mind, embodiments of the present invention allow for the use of both vertically and horizontally polarized antenna arrays. The horizontally polarized antenna arrays of the present invention allow for the efficient distribution of RF energy into a communications environment through, for example, selectable antenna elements, reflectors and/or directors that create and influence a particular radiation pattern (e.g., a substantially omnidirectional radiation pattern). In conjunction with the vertically polarized array, a particular high-gain wireless environment may be created such that one wireless environment does not interfere with other nearby wireless environments (e.g., between floors of an office building) and, further, avoids interference created by the other environments.

One embodiment of the present invention provides for an antenna system. The antenna system may be a multiple-input and multi-output (MIMO) antenna system. The antenna system includes a plurality of horizontally polarized antenna arrays coupled to a vertically polarized antenna array. Each polarized array may be coupled to a different radio. The vertically polarized antenna array may generate a radiation pattern substantially perpendicular to a radiation pattern generated by one of the horizontally polarized antenna arrays. The horizontally polarized antenna arrays may include antenna elements selectively coupled to a radio frequency feed port.

In some embodiments, the radiation pattern generated by one of the horizontally polarized antenna arrays is substantially omnidirectional and substantially in the plane of the horizontally polarized antenna array when a first and second antenna element are coupled to the radio frequency feed port. In some embodiments, the horizontally polarized antenna array may include a reflector or director to restrain or otherwise influence the radiation pattern generated by the antenna elements coupled to the radio frequency feed port. In other embodiments, one or more of the antenna elements include loading structures that slow down electrons and change the resonance of the antenna elements. The antenna elements, in one embodiment, are oriented substantially to the edges of a square shaped substrate. In another embodiment, the antenna elements are oriented substantially to the edges of a triangular shaped substrate.

Some embodiments of the present invention may implement a series a parasitic elements on an antenna array in the system. At least two of the elements may be selectively coupled to one another by a switching network. Through the selective coupling of the parasitic elements, the elements may collectively operate as a reflector or a director, whereas prior to the coupling the elements may have been effectively invisible to an emitted radiation pattern. By collectively operating as, for example, a reflector, a radiation pattern emitted by the driven elements of an array may be influenced through the reflection back of the pattern in a particular direction thereby increasing the gain of the pattern in that direction.

In some embodiments of the present invention, the radio frequency feed port of the horizontally polarized antenna array is coupled to an antenna element by an antenna element selector. The antenna element selector, in one embodiment, comprises an RF switch. In another embodiment, the antenna element selector comprises a p-type, intrinsic, n-type (PIN) diode.

In one embodiment of the antenna system, the horizontally polarized antenna arrays are coupled to the vertically polarized antenna array by fitting the vertical array inside one or more rectangular slits in the printed circuit board (PCB) of the horizontal arrays. Connector tabs on the vertical array may be soldered to the horizontal arrays at the one or more rectangular slits in the PCBs of the horizontal arrays.

In another embodiment of the presently disclosed antenna system, the horizontal and vertically polarized antenna arrays may be coupled by a PCB connector element. A portion of the PCB connector element may fit inside the one or more rectangular slits formed within the PCB of the horizontally polarized antenna array. A connector tab on the PCB connector element may be soldered to the horizontally polarized array at a rectangular slit. The PCB connector may also be soldered to the vertically polarized antenna array. For example, soldering may occur at a feed intersection on the PCB of the horizontal and/or vertical arrays and/or the PCB connector. A zero Ohm resistor placed to jumper the RF trace may also be used to effectuate the coupling.

A still further embodiment of the present invention discloses an antenna system that includes horizontally polarized antenna arrays with plural antenna elements configured to be selectively coupled to a radio frequency feed port. A substantially omnidirectional radiation pattern substantially in the plane of the horizontally polarized antenna arrays is generated when a first antenna element and a second antenna element of the plurality of antenna elements are coupled to the radio frequency feed port. The system further includes vertically polarized antenna arrays coupled to the horizontally polarized antenna arrays. The vertically polarized antenna arrays generate a radiation pattern substantially perpendicular to a radiation pattern generated by the plurality of horizontally polarized antenna arrays.

In one alternative embodiment, each of the horizontally polarized antenna arrays are coupled to one of the vertically polarized antenna arrays by fitting each one of the vertically polarized antenna arrays inside a rectangular slit formed within the printed circuit board of one of the horizontally polarized antenna arrays. In another alternative embodiment, each of the horizontally polarized antenna arrays are coupled to one of the vertically polarized antenna arrays by fitting a portion of a printed circuit board connector element inside a rectangular slit formed within the printed circuit board of one of the horizontally polarized antenna arrays. Each of the vertically polarized antenna arrays are soldered to a printed circuit board connector element at a connector tab.

DETAILED DESCRIPTION

Figure 1:
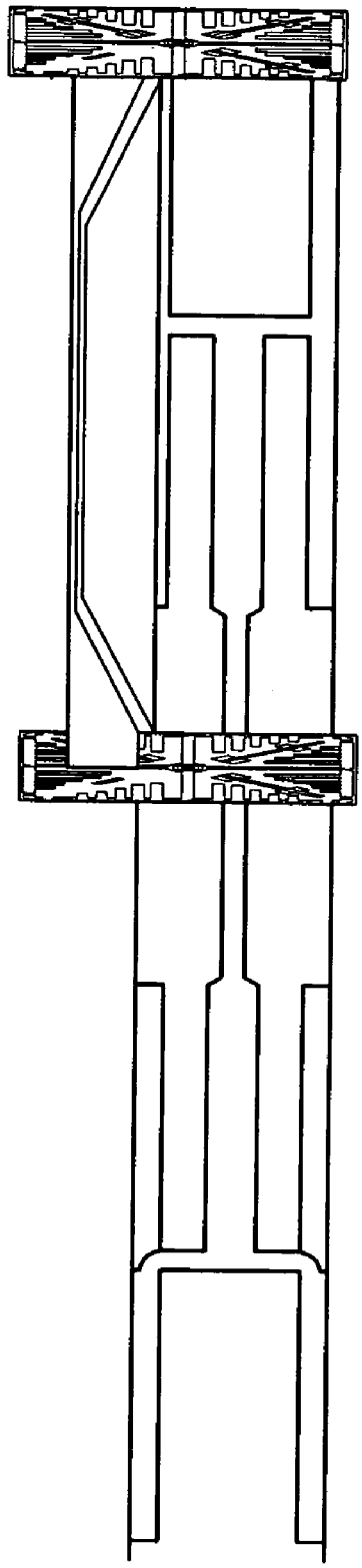
FIG. 1 illustrates an exemplary dual polarized, high-gain, omnidirectional antenna system in accordance with an embodiment of the present invention.

FIG. 1 illustrates an exemplary dual polarized, high-gain, omnidirectional antenna system 100 in accordance with an embodiment of the present invention. Any reference to the presently disclosed antenna systems being coaxial in nature should not be interpreted (exclusively) as an antenna element consisting of a hollow conducting tube through which a coaxial cable is passed. In certain embodiments of the antenna systems disclosed herein (such as antenna system 100), two horizontal antenna arrays sharing a common axis including a vertical antenna array are disclosed. Such systems are coaxial to the extent that those horizontal arrays share the aforementioned common vertical axis formed by the vertical array although other configurations are envisioned. Notwithstanding, various cabling mechanisms may be used with respect to a communications device implementing the presently disclosed dual polarized, high-gain, omnidirectional antenna system 100 including a coaxial feed.

While perpendicular horizontal and vertical antenna arrays are disclosed, it is not necessary that the various arrays be perpendicular to one another along the aforementioned axis (e.g., at a 90 degree intersection). Various array configurations are envisioned in the practice of the presently disclosed invention. For example, a vertical array may be coupled to another antenna array positioned at a 45 degree angle with respect to the vertical array. Utilizing various intersection angles with respect to the two or more arrays may further allow for the shaping of a particular RF emission pattern.

Figure 2A:
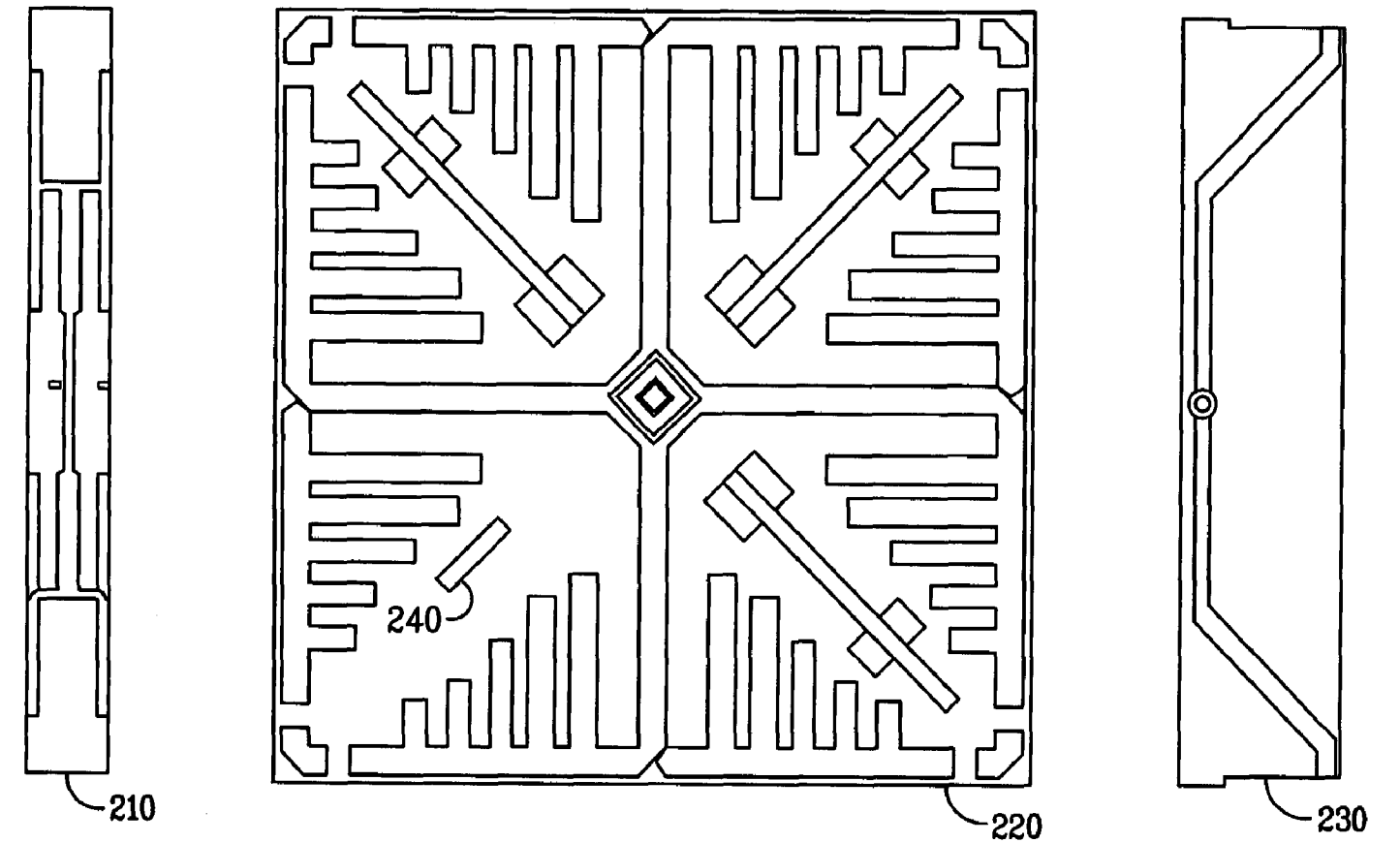
FIG. 2A illustrates the individual components of antenna system as referenced in FIG. 1 and implemented in an exemplary embodiment of the present invention including a vertically polarized omnidirectional array, two horizontally polarized omnidirectional arrays, and a feed PCB.

FIG. 2A illustrates the individual components of antenna system 100 as referenced in FIG. 1 and implemented in an exemplary embodiment of the present invention. Antenna system 100 as illustrated in FIG. 1 includes a vertically polarized omnidirectional array 210, detailed in FIG. 3 below. Antenna system 100 as illustrated in FIG. 1 also includes at least one horizontally polarized omnidirectional antenna array 220, discussed in detail with respect to FIGS. 4A-4D. Antenna system 100 as shown in FIG. 1 further includes a feed PCB 230 for coupling, for example, two horizontally polarized omnidirectional antenna arrays like array 220. A different radio may be coupled to each of the different polarizations.

The radiation patterns generated by the varying arrays (e.g., vertical with respect to horizontal) may be substantially similar with respect to a particular RF emission pattern. Alternatively, the radiation patterns generated by the horizontal and the vertical array may be substantially dissimilar versus one another.

Figure 3:
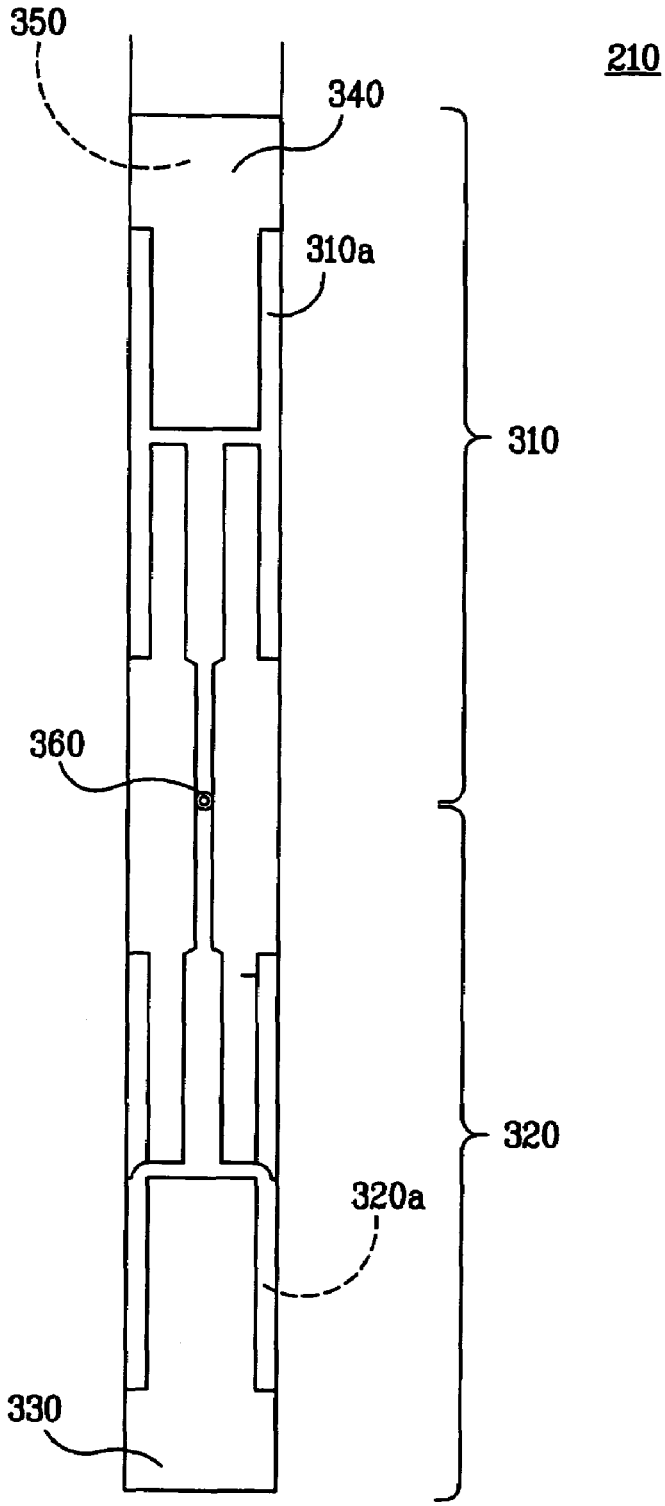
FIG. 3 illustrates an exemplary vertically polarized omnidirectional array as may be implemented in an embodiment of the present invention.

In some embodiments, the vertically polarized array 210 may include two or more vertically polarized elements as is illustrated in detail with respect to FIG. 3. The two vertically polarized elements may be coupled to form vertically polarized array 210. In some embodiments, the vertically polarized array is omnidirectional.

Feed PCB 230 (in some embodiments) couples the horizontally polarized antenna arrays 220 like those illustrated in FIG. 1. In such an embodiment, the feed PCB 230 may couple horizontally polarized omnidirectional arrays at a feed slot 240 located on horizontal array 220. In alternative embodiments, the feed PCB 230 may couple each horizontally polarized omnidirectional antenna array 220 at any place on, or slot within, the antenna or supporting PCB. The feed PCB 230 may be soldered to horizontal antenna array 220 at intersecting trace elements in the PCB. For example, an RF trace in the horizontal array may intersect with a similar trace in the vertical array through intersecting of the arrays as discussed, for example, in the context of FIG. 8.

In some embodiments that omit the aforementioned feed PCB 230, an intermediate component may be introduced at the trace element interconnect such as a zero Ohm resistor jumper. The zero Ohm resistor jumper effectively operates as a wire link that may be easier to manage with respect to size, particular antenna array positioning and configuration and, further, with respect to costs that may be incurred during the manufacturing process versus, for example, the use of aforementioned feed PCB 230. Direct soldering of the traces may also occur. While the feed PCB 230 illustrated in FIGS. 1 and 2A couples two horizontal antenna arrays 220, the horizontal arrays 220 may be further coupled or individually coupled to the vertically polarized antenna array 210 or elements thereof utilizing the techniques discussed above and in the context of FIG. 8. The coupling of the two (or more) arrays via the aforementioned traces may allow for an RF feed to traverse two disparate arrays. For example, the RF feed may 'jump' the horizontally polarized array to the vertically polarized array. Such 'jumping' may occur in the context of various intermediate elements including a zero Ohm resistor and/or a connector tab as discussed herein.

Figure 2B:
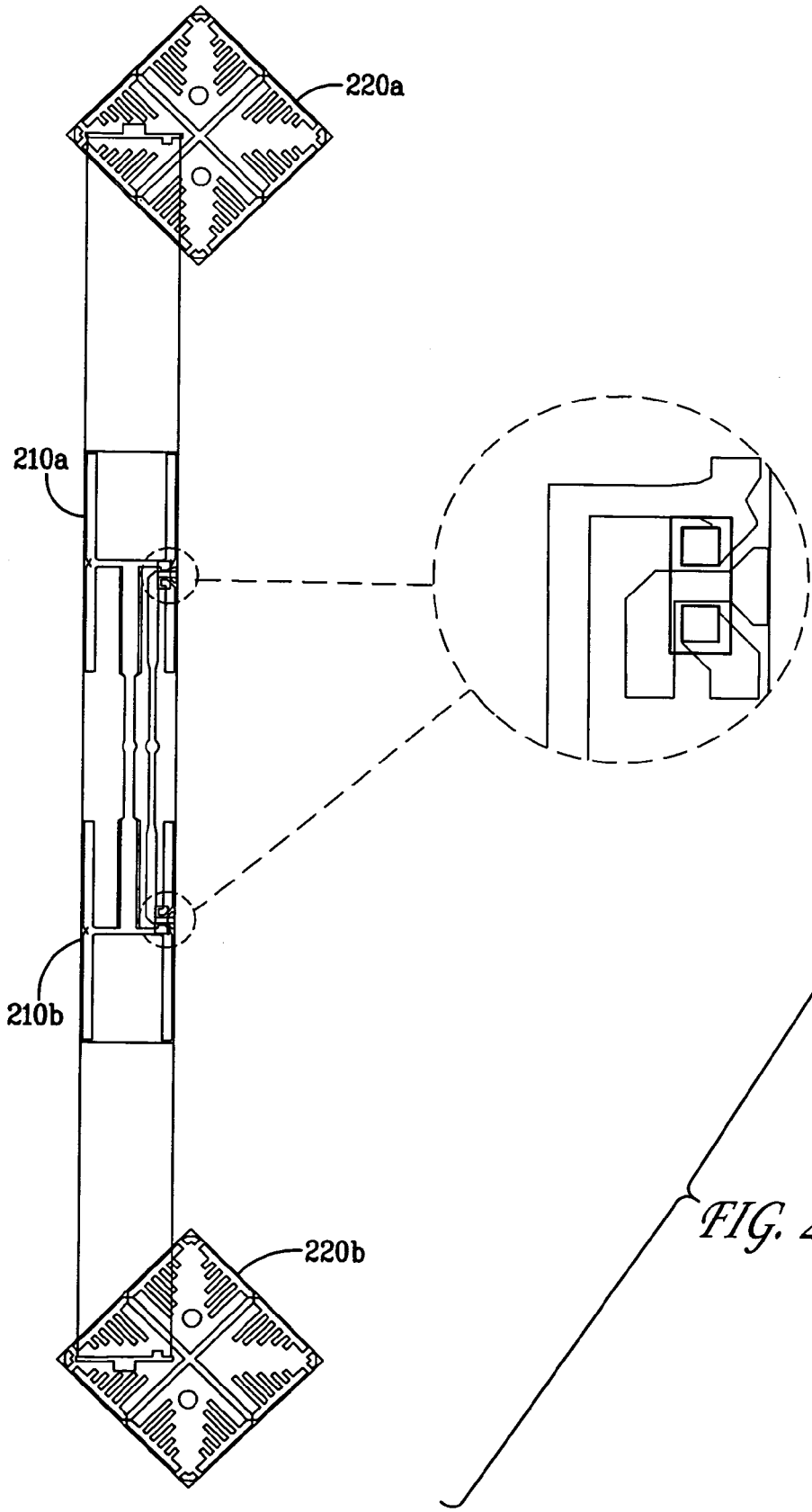
FIG. 2B illustrates an alternative embodiment of the antenna system disclosed in FIG. 1, which does not include a feed PCB.

FIG. 2B illustrates an alternative embodiment of the antenna system disclosed in FIG. 1, which does not include a feed PCB. The embodiment of FIG. 2B includes the aforementioned horizontal arrays 220*a* and 220*b* and the vertical arrays 210*a* and 210*b*. Instead of utilizing feed PCB 230, the various arrays may be coupled to one another through a combination of insertion of arrays through various PCB slits as discussed in the context of FIG. 8 and soldering/jumping feed traces as discussed herein. The inset of FIG. 2B illustrates where such array-to-array coupling may occur.

FIG. 3 illustrates an exemplary vertically polarized omnidirectional array 210 like that shown in FIGS. 1 and 2 and including two antenna elements 310 and 320 as may be implemented in an embodiment of the present invention. The vertically polarized omnidirectional antenna elements 310 and 320 of antenna array 210 may be formed on substrate 330 having a first side 340 and a second side 350. The portions of the vertically polarized omnidirectional array 210 depicted in a dark line 310*a* in FIG. 3 may be on one side (340) of the substrate. Conversely, the portions of the vertically polarized omnidirectional array 210 depicted as dashed lines 320*a* in FIG. 3 may be on the other side (350) of the substrate 330. In some embodiments, the substrate 330 comprises a PCB such as FR4, Rogers 4003, or other dielectric material.

The vertically polarized omnidirectional antenna elements 310 and 320 of antenna array 210 in FIG. 3 are coupled to a feed port 360. The feed port is depicted as a small circle at the base of the vertically polarized omnidirectional array element 310 in FIG. 3. The feed port 360 may be configured to receive and/or transmit an RF signal to a communications device and a coupling network (not shown) for selecting one or more of the antenna elements. The RF signal may be received from, for example, an RF coaxial cable coupled to the aforementioned coupling network. The coupling network may comprise DC blocking capacitors and active RF switches to couple the radio frequency feed port 360 to one or more of the antenna elements. The RF switches may include a PIN diode or gallium arsenide field-effect transistor (GaAs FET) or other switching devices as are known in the art. The PIN diodes may comprise single-pole single-throw switches to switch each antenna element either on or off (i.e., couple or decouple each of the antenna elements to the feed port 360).

Figure 4A:
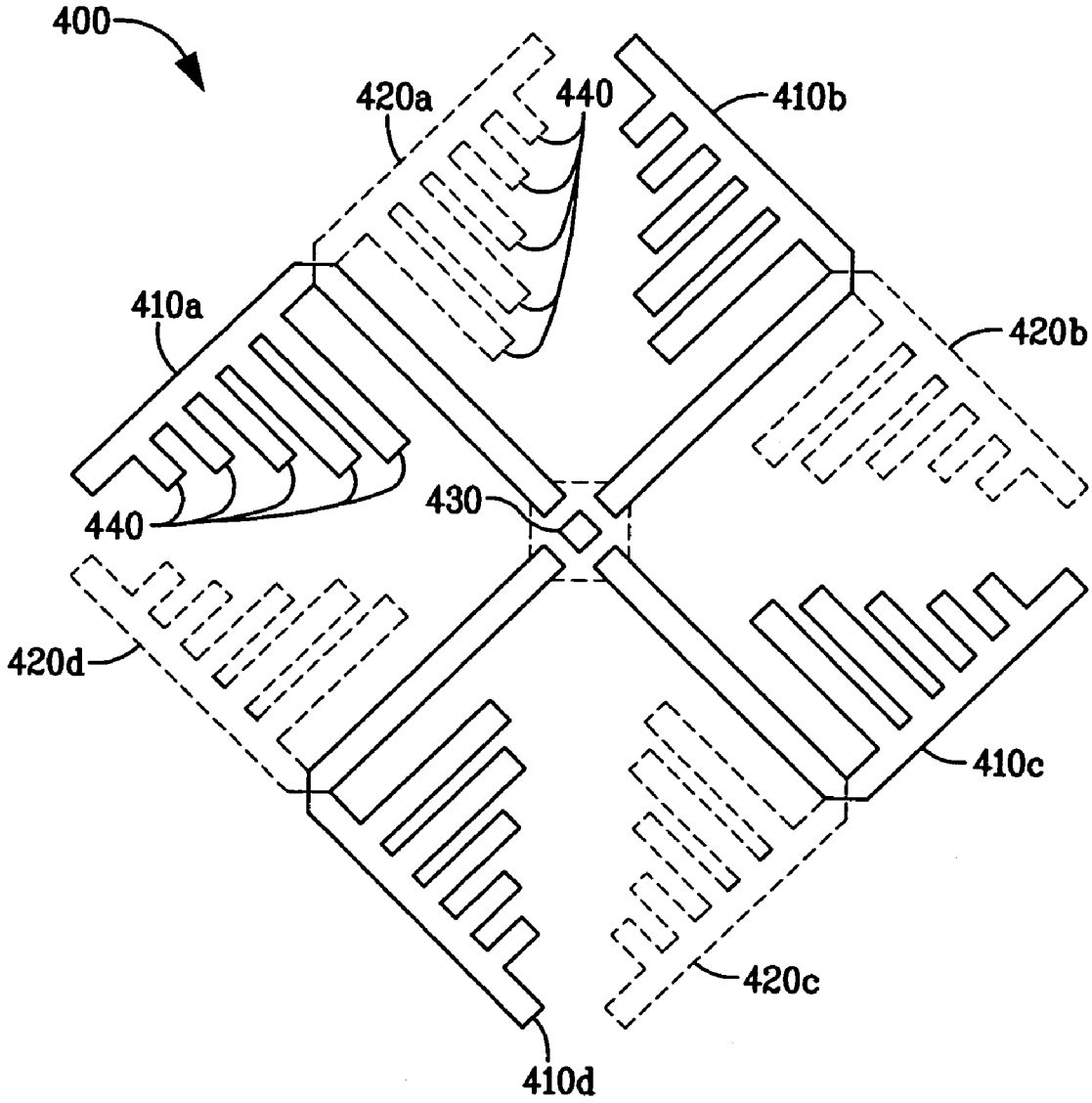
FIG. 4A illustrates a square configuration of a horizontally polarized antenna array with selectable elements as may be implemented in an exemplary embodiment of the present invention.

FIG. 4A illustrates a square configuration of a horizontally polarized antenna array 400 with selectable elements as may be implemented in an exemplary embodiment of the present invention. In FIG. 4A, horizontally polarized antenna array 400 includes a substrate (the plane of FIG. 4A) having a first side (solid lines 410) and a second side (dashed lines 420) that may be substantially parallel to the first side. The substrate may comprise, for example, a PCB such as FR4, Rogers 4003 or some other dielectric material.

On the first side of the substrate (solid lines 410) in FIG. 4A, the antenna array 400 includes a radio frequency feed port 430 and four antenna elements 410*a*-410*d*. Although four modified dipoles (i.e., antenna elements) are depicted in FIG. 4A, more or fewer antenna elements may be implemented with respect to array 400. Further, while antenna elements 410*a*-410*d* of FIG. 4A are oriented substantially to the edges of a square shaped substrate thereby minimizing the size of the antenna array 400, other shapes may be implemented. In some embodiments, the elements may be positioned substantially to the middle or center of the substrate.

Figure 4B:
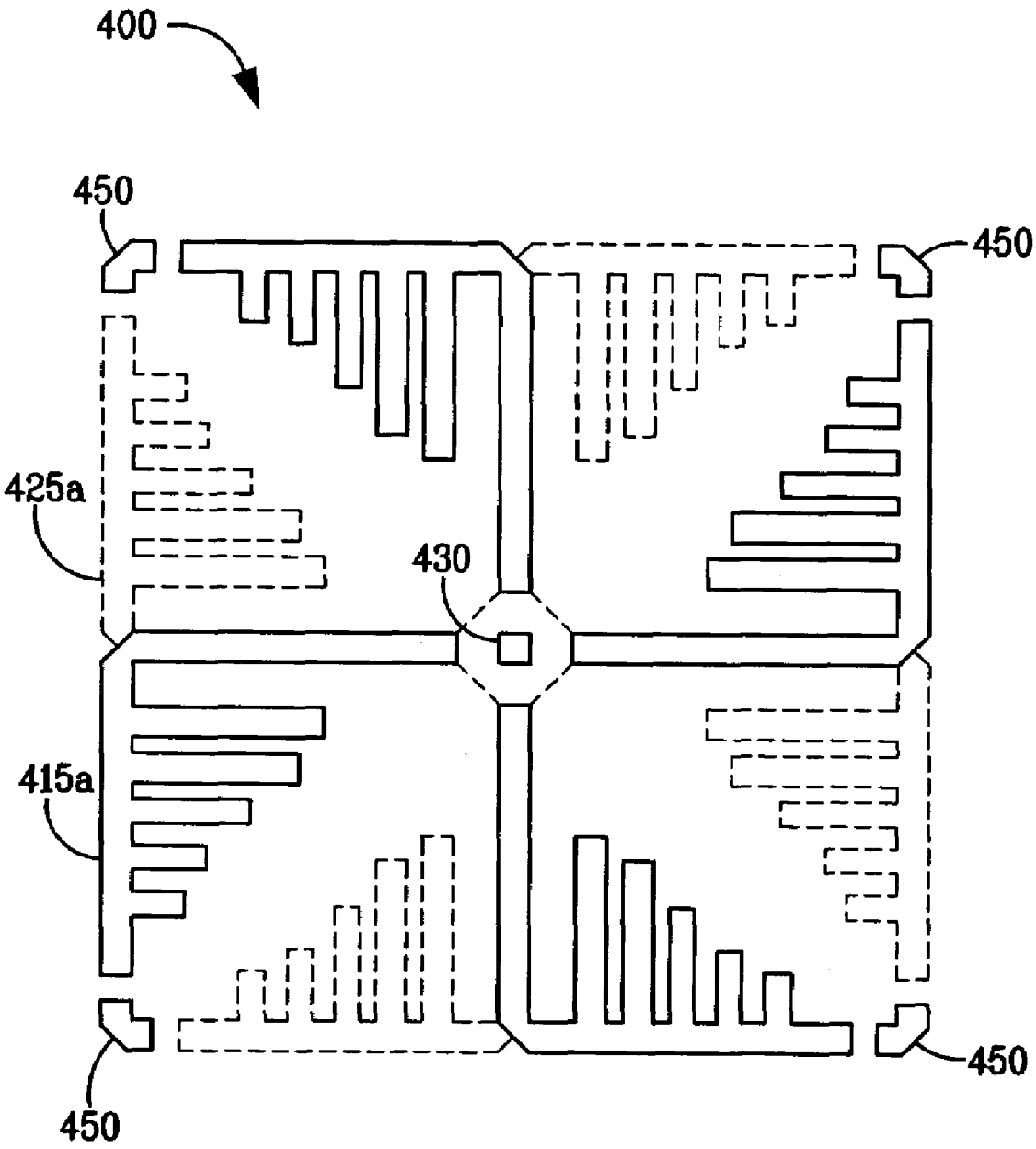
FIG. 4B illustrates a square configuration of a horizontally polarized antenna array with selectable elements and reflector/directors as may be implemented in an alternative embodiment of the present invention.
Figure 4C:
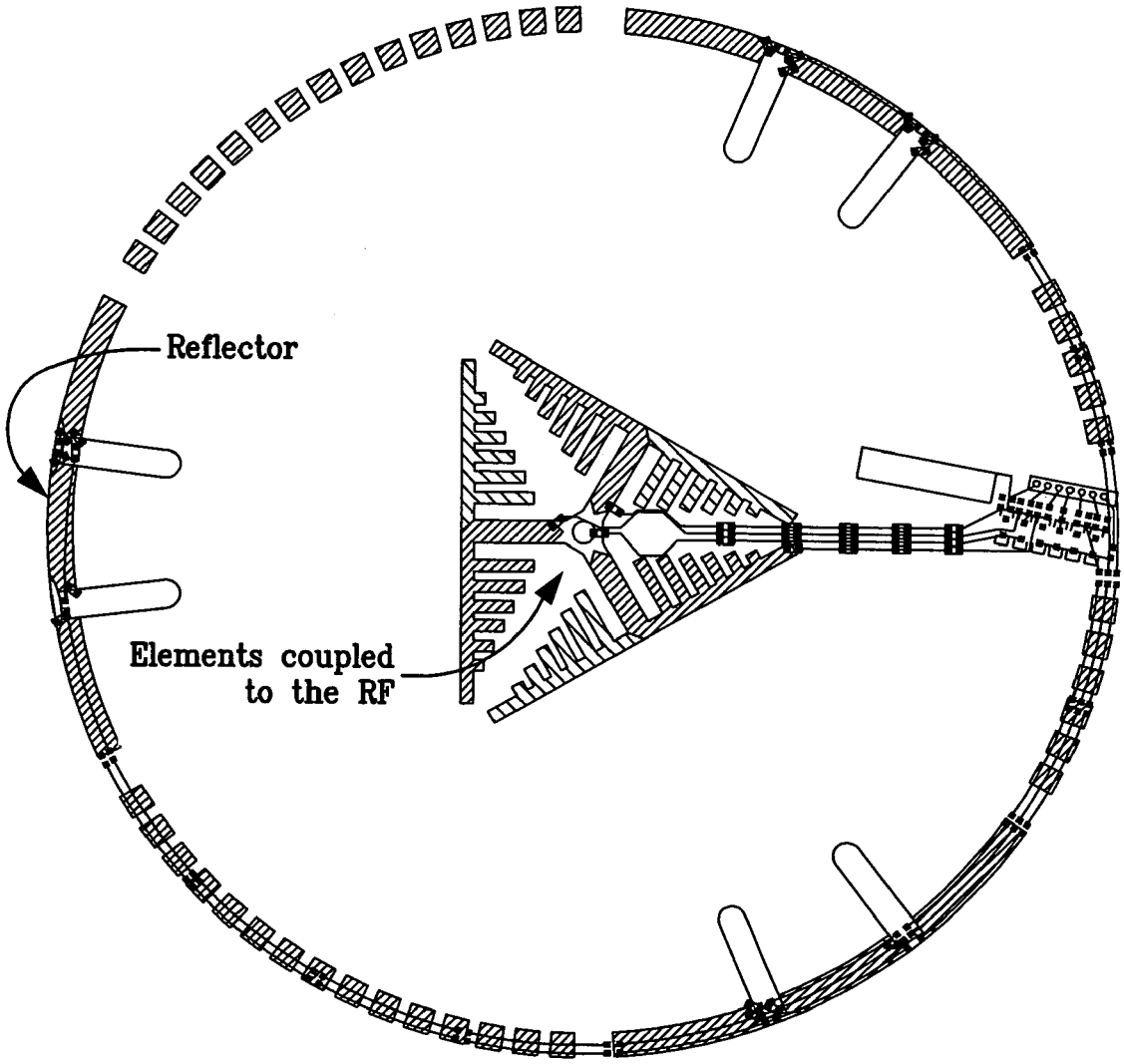
FIG. 4C illustrates an exemplary antenna array including both selectively coupled antenna elements and selectively coupled reflector/directors as may be implemented in an alternative embodiment of the present invention.
Figure 4D:
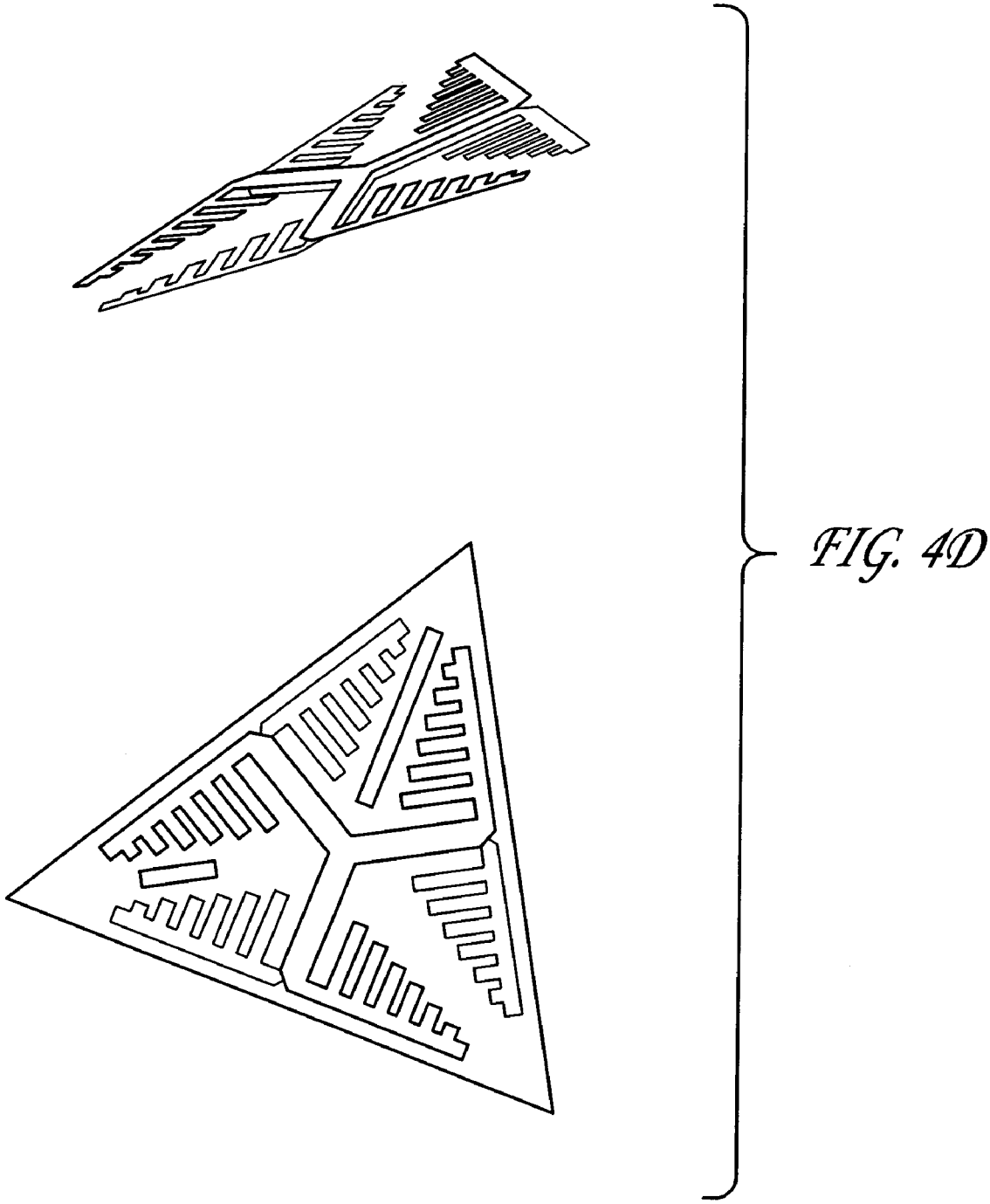
FIG. 4D illustrates a triangular configuration of a horizontally polarized antenna array with selectable elements as may be implemented in an alternative embodiment of the present invention.

For example, FIG. 4D illustrates a triangular configuration of a horizontally polarized antenna array with selectable elements as may be implemented in an alternative embodiment of the present invention. Each side of the triangular horizontally polarized antenna array may be equal or proportional to a side of the square horizontally polarized antenna array 400 as shown in FIG. 4A. Other embodiments may implement unequal or otherwise non-proportional sides with respect to the exemplary square configurations illustrated in, for example, FIG. 4A. The antenna elements on the triangular array, like its square-shaped counterpart, may be positioned substantially to the edge or the middle/center of the array.

Returning to FIG. 4A, although the antenna elements 410*a*-410*d* form a radially symmetrical layout about the radio frequency feed port 430, a number of non-symmetrical layouts, rectangular layouts, and/or layouts symmetrical in only one axis, may be implemented. Furthermore, the antenna elements 410*a*-410*d* need not be of identical dimension notwithstanding FIG. 4A's depiction of the same.

On the second side of the substrate, depicted as dashed lines in FIG. 4A, the antenna array 400 includes a ground component 420. A portion of the ground component 420 (e.g., the portion 420*a*) may be configured to form a modified dipole in conjunction with the antenna element 410*a*. As shown in FIG. 4A, the dipole is completed for each of the antenna elements 410*a*-410*d* by respective conductive traces 420*a*-420*d* extending in mutually opposite directions. The resultant modified dipole provides a horizontally polarized directional radiation pattern (i.e., substantially in the plane of the antenna array 400), as illustrated in, for example, FIG. 7.

To minimize or reduce the size of the antenna array 400, each of the modified dipoles (e.g., the antenna element 410*a* and the portion 420*a* of the ground component 420) may incorporate one or more loading structures 440. For clarity of illustration, only the loading structures 440 for the modified dipole formed from the antenna element 410*a* and the portion 420*a* are numbered in FIG. 4A. By configuring loading structure 440 to slow down electrons and change the resonance of each modified dipole, the modified dipole becomes electrically shorter. In other words, at a given operating frequency, providing the loading structures 440 reduces the dimension of the modified dipole. Providing the loading structures 440 for one or more of the modified dipoles of the antenna array 400 minimizes the size of the antenna array 440.

FIG. 4B illustrates a square configuration of a horizontally polarized antenna array 400 with selectable elements and reflector/directors as may be implemented in an alternative embodiment of the present invention. The antenna array 400 of FIG. 4B includes one or more reflector/directors 450. The reflector/directors 450 comprise passive elements (versus an active element radiating RF energy) that constrain the directional radiation pattern of the modified dipoles formed by antenna elements 415*a* in conjunction with portions 425*a* of the ground component. For the sake of clarity, only element 415*a* and portion 425*a* are labeled in FIG. 4B. Because of the reflector/directors 450, the antenna elements 415 and the portions 425 are slightly different in configuration from the antenna elements 410 and portions 420 of FIG. 4A. Reflector/directors 250 may be placed on either side of the substrate. Additional reflector/directors (not shown) may be included to further influence the directional radiation pattern of one or more of the modified dipoles.

In some embodiments, the antenna elements may be selectively or permanently coupled to a radio frequency feed port. The reflector/directors (e.g., parasitic elements), however, may be configured such that the length of the reflector/directors may change through selective coupling of one or more reflector/directors to one another. For example, a series of interrupted and individual parasitic elements that are 100 mils in length may be selectively coupled in a manner similar to the selective coupling of the aforementioned antenna elements.

By coupling together a plurality of the aforementioned elements, the elements may effectively become reflectors that reflect and otherwise shape and influence the RF pattern emitted by the active antenna elements (e.g., back toward a drive dipole resulting in a higher gain in that direction). RF energy emitted by an antenna array may be focused through these reflectors/directors to address particular nuances of a given wireless environment. Similarly, the parasitic elements (through decoupling) may be made effectively transparent to any emitted radiation pattern. Similar reflector systems may be implemented on other arrays (e.g., the vertically polarized array).

A similar implementation may be used with respect to a director element or series of elements that may collectively operate as a director. A director focuses energy from source away from the source thereby increasing the gain of the antenna. In some embodiments of the present invention, both reflectors and directors can be used to affect and influence the gain of the antenna structure. Implementation of the reflector/directors may occur on both arrays, a single array, or on certain arrays (e.g., in the case of two horizontal arrays and a single vertical array, the reflector/director system may be present only on one of the horizontal arrays or, alternatively, on neither horizontal array and only the vertical array).

FIG. 4C illustrates an exemplary antenna array including a series of antenna elements that are selectively coupled to a radio feed port. Additionally, the antenna array includes a series of selectively coupled parasitic elements that may collectively operate as, for example, a reflector. Depending on the particular length of the selectively coupled elements, the selectively coupled elements may also function as a director. Selective coupling of both the antenna and parasitic elements may utilize a coupling network and various intermediate elements (e.g., PIN diodes) as discussed above. Through selective coupling control of both antenna and parasitic elements, further control of an RF emission pattern and a resulting wireless environment may result.

Figure 4E:
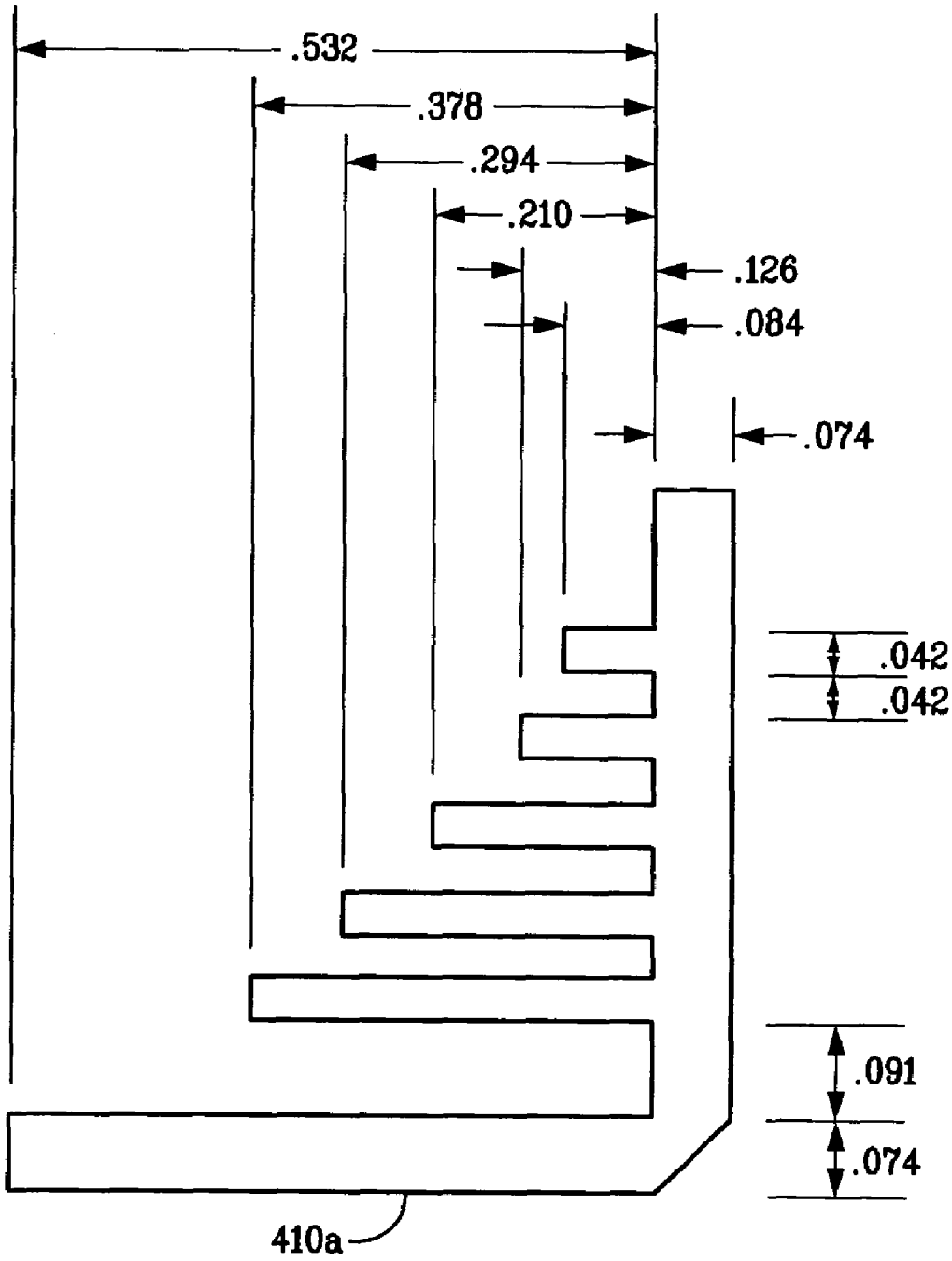
FIG. 4E illustrates an exemplary set of dimensions for one antenna element of the horizontally polarized antenna array shown in FIG. 4A and in accordance with an exemplary embodiment of the present invention.

FIG. 4E illustrates an exemplary set of dimensions for one antenna element of the horizontally polarized antenna array 400 shown in FIG. 4A and in accordance with an exemplary embodiment of the present invention. The dimensions of individual components of the antenna array 400 (e.g., the antenna element 410*a* and the portion 420*a*) may depend upon a desired operating frequency of the antenna array 400. RF simulation software (e.g., IE3D from Zeland Software, Inc.) may aid in establishing the dimensions of the individual components. The antenna component dimensions of the antenna array 400 illustrated in FIG. 4E are designed for operation near 2.4 GHz based on a Rogers 4003 PCB substrate. A different substrate having different dielectric properties, such as FR4, may require different dimensions than those shown in FIG. 4E.

Returning to FIGS. 4A and 4B, radio frequency feed port 430 (in conjunction with any variety of antenna elements) receives an RF signal from and/or transmits an RF signal to a communication device (not shown) in a fashion similar to that of the feed port 360 illustrated in FIG. 3. The communication device may include virtually any device for generating and/or receiving an RF signal. The communication device may include, for example, a radio modulator/demodulator. The communications device may also include a transmitter and/or receiver such as an 802.11 access point, an 802.11 receiver, a set-top box, a laptop computer, an IP-enabled television, a PCMCIA card, a remote control, a Voice Over Internet telephone or a remote terminal such as a handheld gaming device.

In some embodiments, the communication device may include circuitry for receiving data packets of video from a router and circuitry for converting the data packets into 802.11 compliant RF signals as are known in the art. The communications device may comprise an access point for communicating to one or more remote receiving nodes (not shown) over a wireless link, for example in an 802.11 wireless network. The device may also form a part of a wireless local area network by enabling communications among several remote receiving nodes.

As referenced above, an antenna element selector (not shown) may be used to couple the radio frequency feed port 430 to one or more of the antenna elements 410. The antenna element selector may comprise an RF switch (not shown), such as a PIN diode, a GaAs FET, or other RF switching devices as known in the art. In the antenna array 400 illustrated in FIG. 4A, the antenna element selector comprises four PIN diodes, each PIN diode connecting one of the antenna elements 410*a*-410*d* to the radio frequency feed port 430. In this embodiment, the PIN diode comprises a single-pole single-throw switch to switch each antenna element either on or off (i.e., couple or decouple each of the antenna elements 410*a*-410*d* to the radio frequency feed port 430).

A series of control signals may be used to bias each PIN diode. With the PIN diode forward biased and conducting a DC current, the PIN diode switch is on, and the corresponding antenna element is selected. With the diode reverse biased, the PIN diode switch is off. In this embodiment, the radio frequency feed port 430 and the PIN diodes of the antenna element selector are on the side of the substrate with the antenna elements 410*a*-410*d*, however, other embodiments separate the radio frequency feed port 430, the antenna element selector, and the antenna elements 410*a*-410*d*.

In some embodiments, one or more light emitting diodes (LED) (not shown) are coupled to the antenna element selector. The LEDs function as a visual indicator of which of the antenna elements 410*a*-410*d* is on or off. In one embodiment, an LED is placed in circuit with the PIN diode so that the LED is lit when the corresponding antenna element 410 is selected.

In some embodiments, the antenna components (e.g., the antenna elements 410*a*-410*d*, the ground component 420, and the reflector/directors 450) are formed from RF conductive material. For example, the antenna elements 410*a*-410*d* and the ground component 420 may be formed from metal or other RF conducting material. Rather than being provided on opposing sides of the substrate as shown in FIGS. 4A and 4B, each antenna element 410*a*-410*d* is coplanar with the ground component 420. In some embodiments, the antenna components may be conformally mounted to a housing. In such embodiments, the antenna element selector comprises a separate structure (not shown) from the antenna elements 410*a*-410*d*. The antenna element selector may be mounted on a relatively small PCB, and the PCB may be electrically coupled to the antenna elements 410-410*d*. In some embodiments, the switch PCB is soldered directly to the antenna elements 410*a*-410*d*.

In an exemplary embodiment for wireless LAN in accordance with the IEEE 802.11 standard, the antenna arrays are designed to operate over a frequency range of about 2.4 GHz to 2.4835 GHz. With all four antenna elements 410*a*-410*d* selected to result in an omnidirectional radiation pattern, the combined frequency response of the antenna array 400 is about 90 MHz. In some embodiments, coupling more than one of the antenna elements 410*a*-410*d* to the radio frequency feed port 430 maintains a match with less than 10 dB return loss over 802.11 wireless LAN frequencies, regardless of the number of antenna elements 410*a*-410*d* that are switched on.

Selectable antenna elements 410*a*-410*d* may be combined to result in a combined radiation pattern that is less directional than the radiation pattern of a single antenna element. For example, selecting all of the antenna elements 410*a*-410*d* results in a substantially omnidirectional radiation pattern that has less directionality than the directional radiation pattern of a single antenna element. Similarly, selecting two or more antenna elements (e.g., the antenna element 410*a* and the antenna element 410*c* oriented opposite from each other) may result in a substantially omnidirectional radiation pattern. In this fashion, selecting a subset of the antenna elements 410*a*-410*d*, or substantially all of the antenna elements 410*a*-410*d*, may result in a substantially omnidirectional radiation pattern for the antenna array 400. Reflector/directors 450 may further constrain the directional radiation pattern of one or more of the antenna elements 410*a*-410*d* in azimuth. Other benefits with respect to selectable configurations are disclosed in U.S. patent application Ser. No. 11/041,145 filed Jan. 21, 2005 and entitled "System and Method for a Minimized Antenna Apparatus with Selectable Elements," the disclosure of which has previously been incorporated herein by reference.

Figure 5:
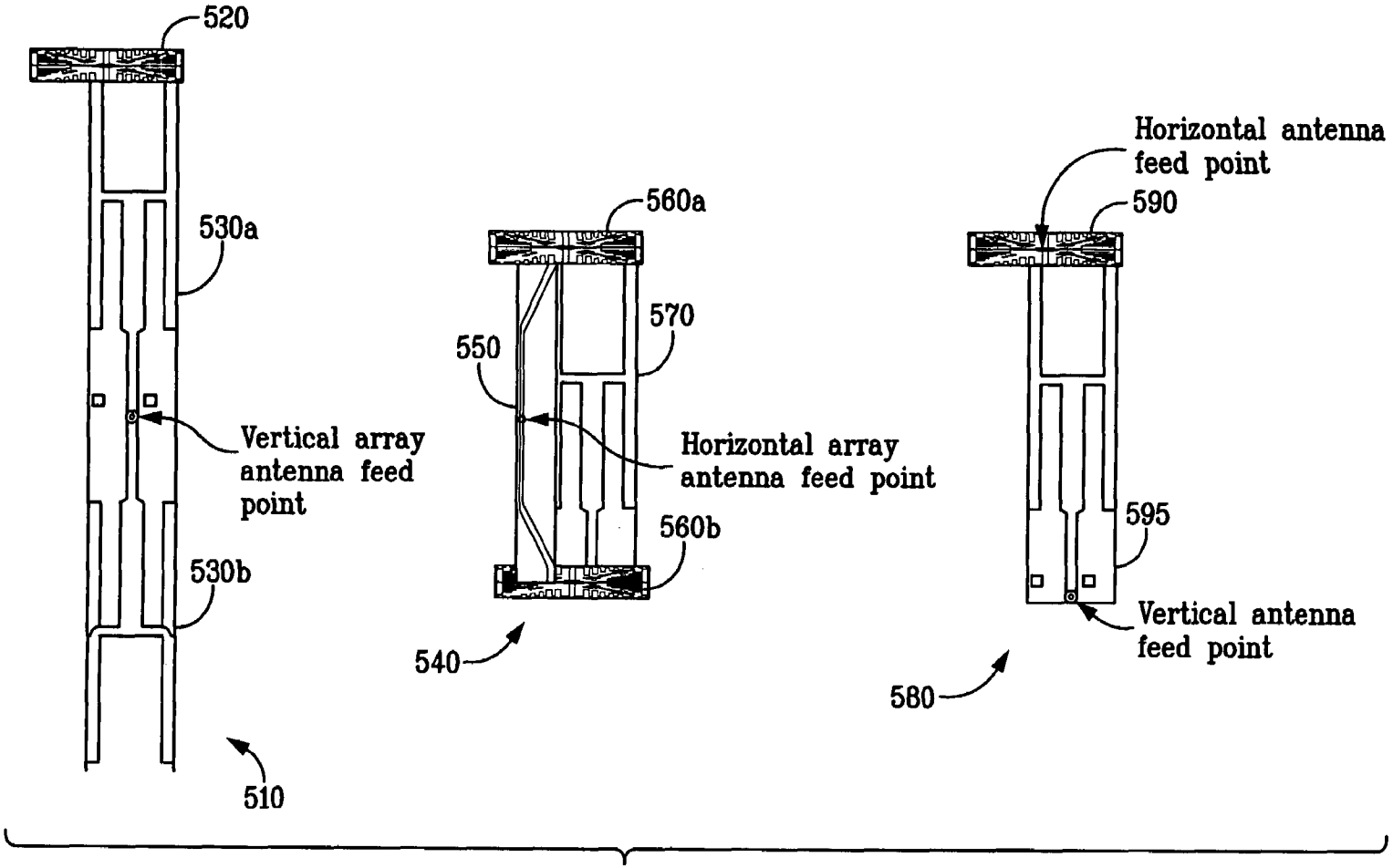
FIG. 5 illustrates a series of low-gain antenna arrays in accordance with alternative embodiments of the present invention.

FIG. 5 illustrates a series of low-gain antenna arrays in accordance with alternative embodiments of the present invention. In antenna array 510, a horizontally polarized omnidirectional array 520 is coupled to two vertically polarized omnidirectional arrays 530*a* and 530*b*. The vertically polarized omnidirectional arrays (530*a* and 530*b*) may produce a higher gain radiation pattern while the horizontally polarized omnidirectional arrays 520 may produce a lower gain radiation pattern.

In antenna array 540, a feed PCB 550 is coupled to the two horizontally polarized omnidirectional arrays 560*a* and 560*b*, which are (in turn) coupled to the one vertically polarized omnidirectional array 570. The feed PCB 550 and two horizontally polarized omnidirectional arrays 560*a* and 560*b* may produce a higher gain radiation pattern while the vertically polarized omnidirectional array 570 produces a lower gain radiation pattern.

In yet another embodiment (580), a single horizontally polarized omnidirectional array 590 may be coupled to one vertically polarized omnidirectional array 595. The horizontally polarized omnidirectional array 590 and the vertically polarized omnidirectional array 595 may each produce a lower gain radiation pattern.

Figure 6:
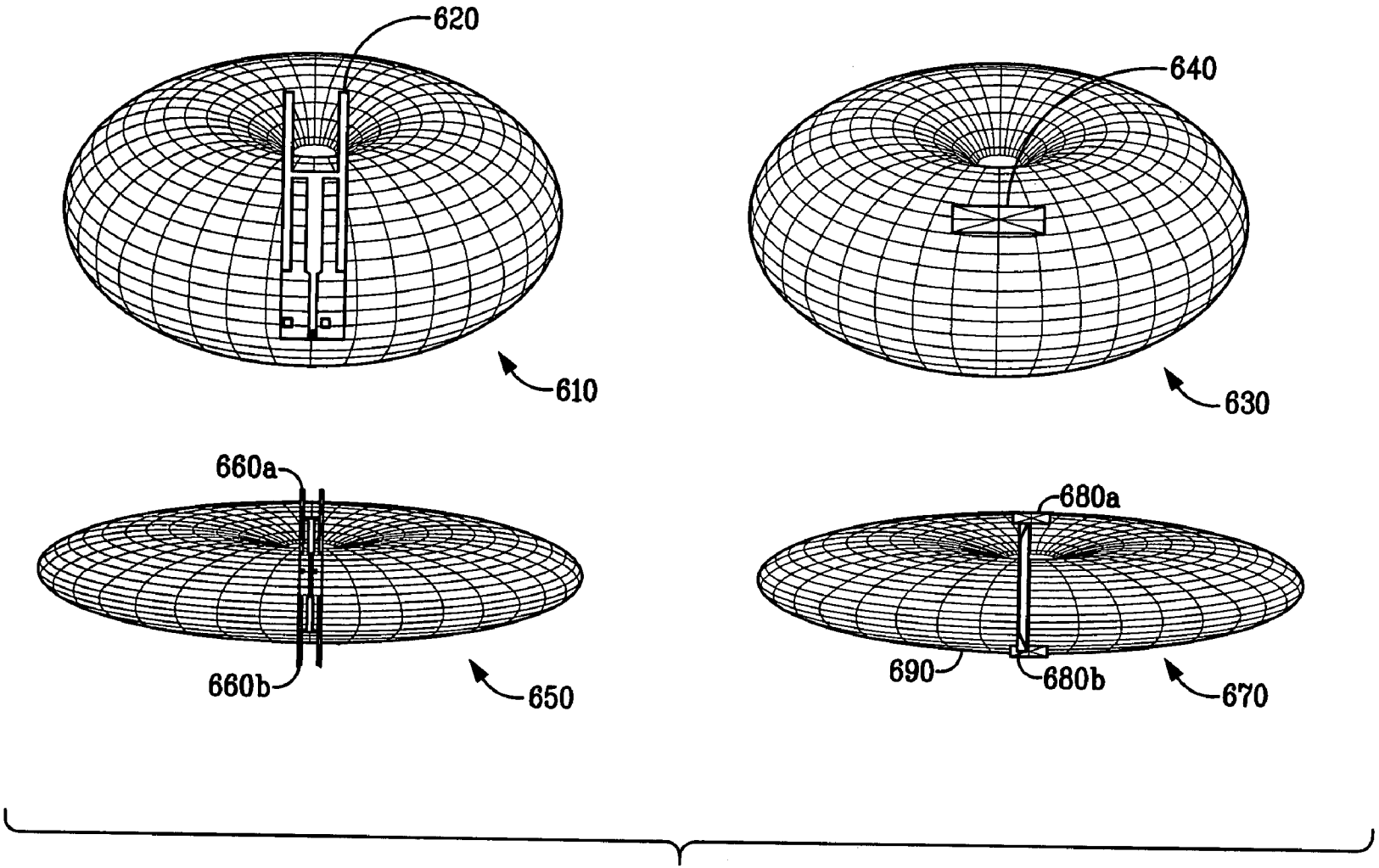
FIG. 6 illustrates a series of radiation patterns that may result from implementation of various embodiments of the present invention.

FIG. 6 illustrates a series of possible radiation patterns that may result from implementation of various embodiments of the present invention. In pattern 610, a single vertical antenna array 620 emits a low-gain radiation pattern. In pattern 630, a single horizontal array 640 emits a similar low-gain radiation pattern. A dual vertical array of antenna elements 660*a* and 660*b* emits a higher gain radiation pattern 650 as does a pair of horizontal antenna elements 680*a* and 680*b* coupled by a PCB feed line 690 with respect to pattern 670.

Figure 7:
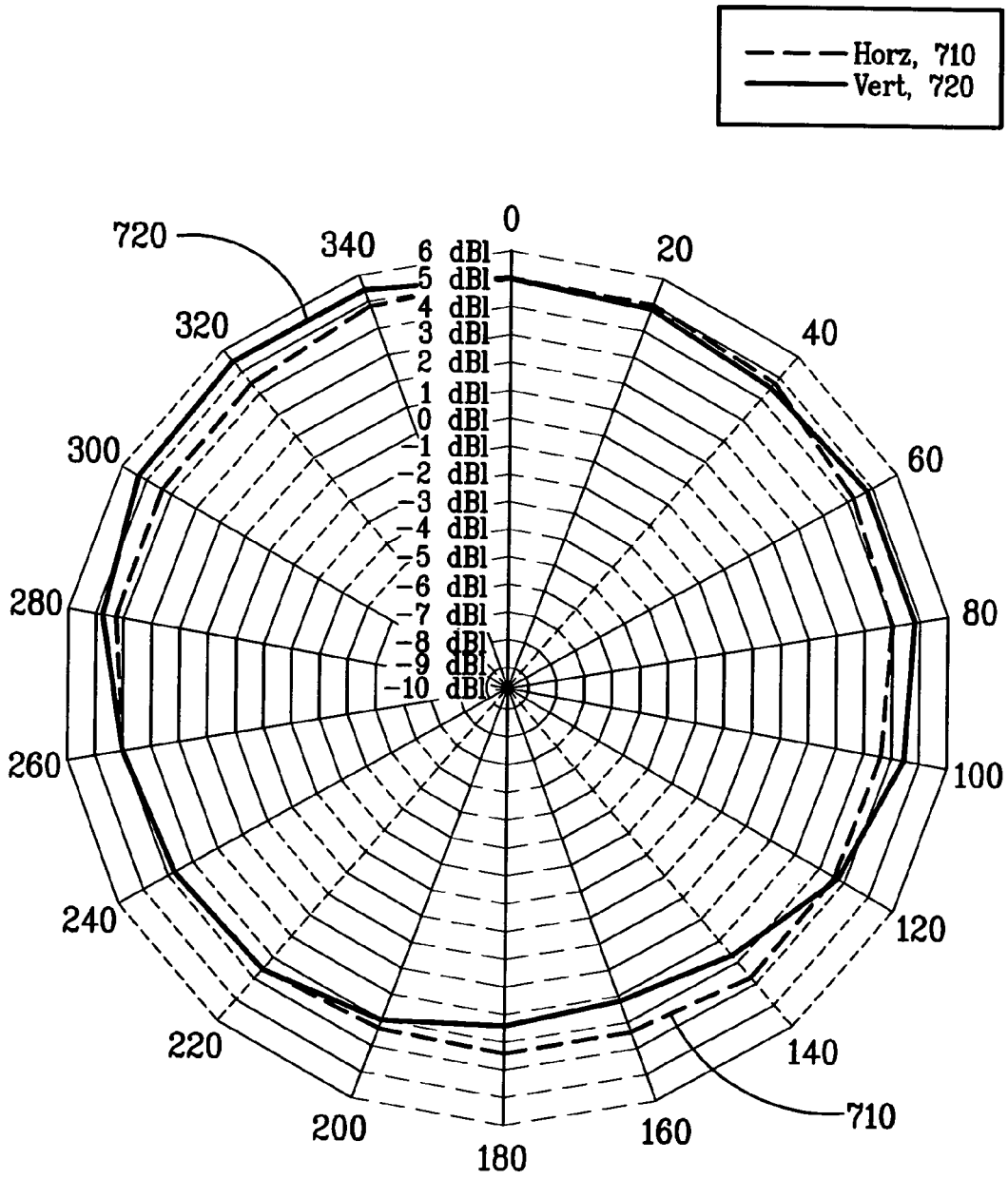
FIG. 7 illustrates plots of a series of measured radiation patterns with respect to a horizontal and vertical antenna array.

FIG. 7 illustrates plots of a series of measured radiation patterns 700. For example, plot 710 illustrates exemplary measured radiation patterns with respect to an exemplary horizontal array. By further example, plot 720 illustrates exemplary measured radiation patterns with respect to an exemplary vertical antenna array.

Figure 8:
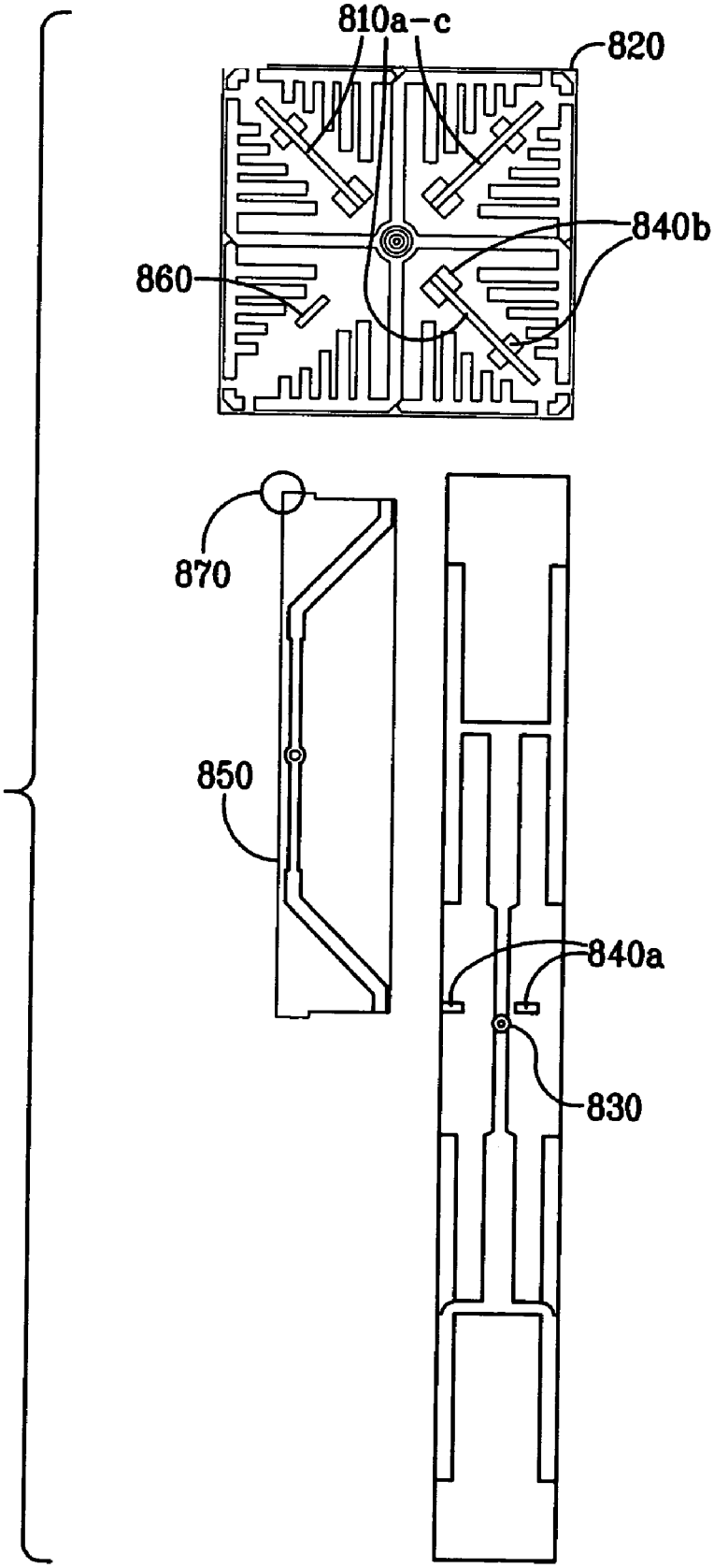
FIG. 8 illustrates exemplary antenna structure mechanicals for coupling the various antenna arrays and PCB feeds disclosed in various embodiments of the present invention.

FIG. 8 illustrates exemplary antenna structure mechanicals for coupling the various antenna arrays and PCB feeds disclosed in various embodiments of the present invention. Small rectangular slits 810*a*-810*c* may be formed within the PCB of a horizontally polarized omnidirectional array 820. Similarly, small rectangular slits may be formed within the PCB of a vertically polarized omnidirectional array 830. The vertically polarized omnidirectional array 830 may fit inside one of the slits 810*c* of the horizontally polarized omnidirectional array 820. Connector tabs 840*a* of the vertically polarized omnidirectional array 830 may be soldered to connector tabs 840*b* of the horizontally polarized omnidirectional array 820. In some embodiments, the connector tabs comprise copper. One or more vertically polarized omnidirectional arrays 830 may fit within the horizontally polarized omnidirectional array 820 via the slits 810*a*-810*c*. The coupling of the two (or more) arrays via the connector tab (or any other coupling mechanism such as direct soldering) may allow for an RF feed to traverse two disparate arrays. For example, the RF feed may 'jump' the horizontally polarized array to the vertically polarized array.

One or more feed PCBs 850 may also fit into a small slit 860 within the horizontally polarized omnidirectional array 820. Specifically, a specifically configured portion 870 of the feed PCB 850 fits within small slit 860. One or more feed PCBs 850 may be coupled to the horizontally polarized omnidirectional array 820 in this fashion. In other embodiments, one or more feed PCBs 850 may be coupled to the vertically polarized omnidirectional array 830. The aforementioned connector tab/soldering methodology may also be used in this regard. Similarly, one or more horizontally polarized omnidirectional arrays 820 may be coupled to one or more vertically polarized omnidirectional arrays 830 in any number of ways. Similarly, those skilled in the art will appreciate that the feed PCB 850 may be coupled to one or more horizontally polarized omnidirectional arrays 820 and/or one or more vertically polarized omnidirectional arrays 830.

Figure 9:
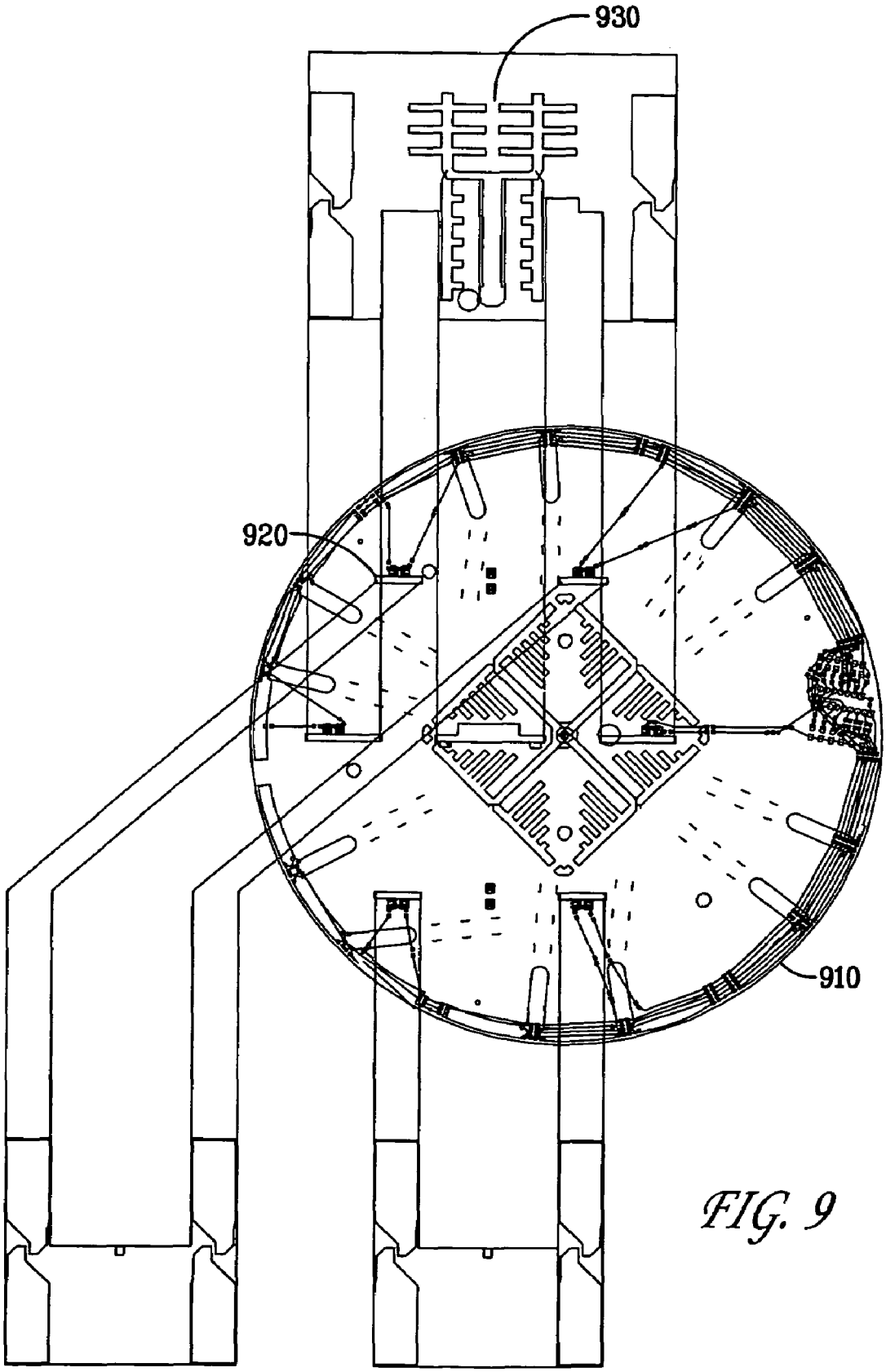
FIG. 9 illustrates alternative antenna structure mechanicals for coupling more than one vertical antenna array to a horizontal array wherein the coupling includes a plurality of slots in the PCB of the horizontal array.

FIG. 9 illustrates alternative antenna structure mechanicals for coupling more than one vertical antenna array to a horizontal array wherein the coupling includes a plurality of slots in the PCB of the horizontal array. As seen in FIG. 9, the horizontal array 910 includes multiple slots 920 for receiving a vertical array 930. The actual coupling of the horizontal 910 and vertical array 930 may occur in a fashion similar to those disclosed above (e.g., direct soldering at a trace and/or use of a jumper resistor).

The embodiments disclosed herein are illustrative. Various modifications or adaptations of the structures and methods described herein may become apparent to those skilled in the art. For example, embodiments of the present invention may be used with respect to MIMO wireless technologies that use multiple antennas as the transmitter and/or receiver to produce significant capacity gains over single-input and single-output (SISO) systems using the same bandwidth and transmit power. Examples of such MIMO antenna systems are disclosed in U.S. provisional patent application No. 60/865,148, which has previously been incorporated herein by reference. Such modifications, adaptations, and/or variations that rely upon the teachings of the present disclosure and through which these teachings have advanced the art are considered to be within the spirit and scope of the present invention. Hence, the descriptions and drawings herein should be limited by reference to the specific limitations set forth in the claims appended hereto.

What is claimed is:

1. A multiple-input, multiple-output (MIMO) antenna system, comprising:

at least one horizontally polarized antenna; and a vertically polarized antenna coupled to the at least one horizontally polarized antenna, wherein the at least one horizontally polarized antenna is coupled to the vertically polarized antenna by fitting the vertically polarized antenna inside at least one rectangular slit formed within the printed circuit board of the at least one horizontally polarized antenna.

2. The MIMO antenna system of claim 1, wherein the polarization of the vertically polarized antenna is substantially perpendicular to the polarization of the at least one horizontally polarized antenna.

3. The MIMO antenna system of claim 1, wherein the radiation pattern of the vertically polarized antenna is substantially similar to the radiation pattern of the at least one horizontally polarized antenna.

4. The MIMO antenna system of claim 1, wherein the radiation pattern of the vertically polarized antenna is substantially dissimilar to the radiation pattern of the at least one horizontally polarized antenna.

5. The MIMO antenna system of claim 1, wherein the at least one horizontally polarized antenna includes a plurality of antenna elements configured to be selectively coupled to a radio frequency feed port.

6. The MIMO antenna system of claim 5, wherein a substantially omnidirectional radiation pattern substantially in the plane of the at least one horizontally polarized antenna is generated when a first antenna element and a second antenna element of the plurality of antenna elements are coupled to the radio frequency feed port.

7. The MIMO antenna system of claim 6, further comprising at least one reflector or director configured to influence the radiation pattern of the first antenna element and the second antenna element coupled to the radio frequency feed port.

8. The MIMO antenna system of claim 5, wherein at least one of the plurality of antenna elements includes a loading structure configured to slow down electrons and change the resonance of the at least one of the plurality of antenna elements.

9. The MIMO antenna system of claim 5, wherein the plurality of antenna elements on the at least one horizontally polarized antenna are oriented substantially to the edges of a square shaped substrate.

10. The MIMO antenna system of claim 5, wherein the plurality of antenna elements on the at least one horizontally polarized antenna are oriented substantially to the middle of a square shaped substrate.

11. The MIMO antenna system of claim 5, wherein the plurality of antenna elements on the at least one horizontally polarized antenna are oriented substantially to the edges of a triangular shaped substrate.

12. The MIMO antenna system of claim 5, wherein the plurality of antenna elements on the at least one horizontally polarized antenna are oriented substantially to the middle of a triangular shaped substrate.

13. The MIMO antenna system of claim 5, wherein the radio frequency feed port is configured to be selectively coupled to at least one of the plurality of antenna elements by an antenna element selector.

14. The MIMO antenna system of claim 13, wherein the antenna element selector comprises an RF switch.

15. The MIMO antenna system of claim 13, wherein the antenna element selector comprises a diode.

16. The MIMO antenna system of claim 15, wherein the diode includes a PIN diode.

17. The MIMO antenna system of claim 1, wherein a connector tab on the vertically polarized antenna is soldered to the at least one horizontally polarized at the at least one rectangular slit formed within the printed circuit board of the at least one horizontally polarized antenna.

18. The MIMO antenna system of claim 1, wherein each antenna is coupled to a different radio.

19. The MIMO antenna system of claim 1, wherein each of the at least one horizontally polarized antenna and the vertically polarized antenna includes a plurality of parasitic antenna elements, at least two of the plurality of parasitic antenna elements on each of the horizontally and vertically polarized antenna configured to be selectively coupled to one another by a switching network, the selective coupling of the at least two of the plurality of parasitic antenna elements causing each of the at least two of the plurality of parasitic antenna elements to collectively reflect a radiation pattern energy back toward a source of the radiation pattern, the reflection of the radiation pattern increasing gain of the reflected radiation pattern in the direction of pattern reflection.

20. The MIMO antenna system of claim 1, wherein at least one of the at least one horizontally polarized antenna and the vertically polarized antenna includes a plurality of parasitic antenna elements, at least two of the plurality of parasitic antenna elements on each of the horizontally and vertically polarized antenna configured to be selectively coupled to one another by a switching network, the selective coupling of the at least two of the plurality of parasitic antenna elements causing each of the at least two of the plurality of parasitic antenna elements to collectively reflect a radiation pattern energy back toward a source of the radiation pattern, the reflection of the radiation pattern increasing gain of the reflected radiation pattern in the direction of pattern reflection.

21. A multiple-input, multiple-output (MIMO) antenna system, comprising:

at least one horizontally polarized antenna; and a vertically polarized antenna coupled to the at least one horizontally polarized antenna, wherein the at least one horizontally polarized antenna is coupled to the vertically polarized antenna by a printed circuit board connector element by fitting a portion of the printed circuit board connector element inside a rectangular slit formed within the printed circuit board of the at least one horizontally polarized antenna thereby allowing a radio frequency (RF) feed to traverse the at least one horizontally polarized antenna and the vertically polarized antenna.

22. The MIMO antenna system of claim 21, wherein a connector tab on the printed circuit board connector element is soldered to the at least one horizontally polarized at the rectangular slit formed within the printed circuit board of the at least one horizontally polarized antenna.

23. The MIMO antenna system of claim 22, wherein the printed circuit board connector element is also soldered to the vertically polarized antenna at a connector tab.

24. A multiple-input, multiple-output (MIMO) antenna system, comprising:

at least one horizontally polarized antenna; and a vertically polarized antenna coupled to the at least one horizontally polarized antenna, wherein the at least one horizontally polarized antenna is coupled to the vertically polarized antenna at an intersecting trace element in the printed circuit board of both the at least one horizontally polarized antenna and the vertically polarized antenna thereby allowing an RF feed to traverse the at least one horizontally polarized antenna and the vertically polarized antenna.

25. The MIMO antenna system of claim 24, wherein the at least one horizontally polarized antenna and vertically polarized antenna are further coupled by a zero Ohm resistor jumper at the intersecting trace element.

26. A multiple-input, multiple-output (MIMO) antenna system, comprising:

a plurality of horizontally polarized antennas each including a plurality of antenna elements configured to be selectively coupled to a radio frequency feed port, wherein coupling a first antenna element and a second antenna element to the radio frequency feed port generates a substantially omnidirectional radiation pattern substantially in the plane of the horizontally polarized antennas; and a plurality of vertically polarized antennas coupled to the plurality of horizontally polarized antennas, wherein the plurality of vertically polarized antennas are configured to generate a radiation pattern substantially perpendicular to a radiation pattern generated by the plurality of horizontally polarized antennas, wherein each of the plurality of horizontally polarized antennas are coupled to one of the plurality of vertically polarized antennas by fitting each one of the plurality of vertically polarized antennas inside at least one rectangular slit formed within the printed circuit board of one of the plurality of horizontally polarized antennas.

27. A multiple-input, multiple-output (MIMO) antenna system, comprising:

a plurality of horizontally polarized antennas each including a plurality of antenna elements configured to be selectively coupled to a radio frequency feed port, wherein coupling a first antenna element and a second antenna element to the radio frequency feed port generates a substantially omnidirectional radiation pattern substantially in the plane of the horizontally polarized antennas; and a plurality of vertically polarized antennas coupled to the plurality of horizontally polarized antennas, wherein the plurality of vertically polarized antennas are configured to generate a radiation pattern substantially perpendicular to a radiation pattern generated by the plurality of horizontally polarized antennas, wherein each of the plurality of horizontally polarized antennas are coupled to one of the plurality of vertically polarized antennas by fitting a portion of a printed circuit board connector element inside at least one rectangular slit formed within the printed circuit board of one of the horizontally polarized antennas and soldering each of the plurality of vertically polarized antennas to a printed circuit board connector element at a connector tab.

* * * * *